US010472021B2

(12) United States Patent
Jin et al.

(10) Patent No.: US 10,472,021 B2
(45) Date of Patent: Nov. 12, 2019

(54) FOLDABLE CANOE

(71) Applicant: MY CANOE CO., LTD., Gwangju (KR)

(72) Inventors: Kwang Seuk Jin, Yongin (KR); Kyung il Jung, Pocheon (KR)

( * ) Notice: Subject to any disclaimer, the term of this patent is extended or adjusted under 35 U.S.C. 154(b) by 0 days.

(21) Appl. No.: 15/806,967

(22) Filed: Nov. 8, 2017

(65) Prior Publication Data

US 2018/0127062 A1 May 10, 2018

Related U.S. Application Data

(63) Continuation-in-part of application No. 14/787,015, filed as application No. PCT/KR2014/011115 on Nov. 19, 2014, now Pat. No. 9,815,523.

(30) Foreign Application Priority Data

Nov. 28, 2013 (KR) ..... 10-2013-0145980

(51) Int. Cl.

| | |
|---|---|
| ***B63B 7/00*** | (2006.01) |
| ***B63B 7/04*** | (2006.01) |
| ***B63B 35/71*** | (2006.01) |

(52) U.S. Cl.

CPC ..... *B63B 7/04* (2013.01); *B63B 35/71* (2013.01); *B63B 2007/003* (2013.01); *B63B 2709/00* (2013.01)

(58) Field of Classification Search

CPC ..... B63B 7/00; B63B 2007/006; B63B 7/02; B63B 7/04; B63B 7/06; B63B 35/71

See application file for complete search history.

(56) References Cited

U.S. PATENT DOCUMENTS 6,006,691 A * 12/1999 Wilce ..... A44B 19/32 114/353

2011/0017121 A1* 1/2011 Willis ..... B63B 35/71 114/347

* cited by examiner

*Primary Examiner* — Andrew Polay

(74) *Attorney, Agent, or Firm* — Matthew M. Googe; Robinson IP Law, PLLC

(57) ABSTRACT

A foldable canoe comprising includes: a gunwale formed around the hull, the hull formed of an elongate sheet of synthetic material having multiple folds including at least one longitudinal and one or more horizontal folds, with the hull configured to be folded into a stored configuration along the folds of the elongate sheet; one or more ribs installed across a width of the hull; and a gunwale cap formed of a plurality of adjoining gunwale sections, wherein each of the plurality of adjoining gunwale sections is removably secured to adjacent gunwale sections. In a deployed configuration the plurality of adjoining gunwale sections are joined such that the gunwale cap maintains a shape of the gunwale of the hull, and wherein in a stored configuration the plurality of adjoining gunwale sections are separated such that the gunwale cap is folded into a stowed configuration.

18 Claims, 41 Drawing Sheets

FOLDABLE CANOE

CROSS-REFERENCE TO RELATED APPLICATIONS

This application claims priority to and is a continuation-in-part of U.S. application Ser. No. 14/787,015 for a "Foldable Canoe" filed on Oct. 26, 2015, which is a national stage application of PCT Patent Application No. PCT/KR2014/011115 for a "Foldable Canoe" filed on Nov. 19, 2014, which claims priority to Korean Patent Application No. 10-2013-0145980 filed on Nov. 28, 2013, the contents of which are incorporated herein by reference in their entireties.

FIELD

The present invention generally related to foldable canoes. More particularly, the present invention relates to a foldable canoe that is configured such that it is constructed by folding a single sheet of material along one or more folding lines to facilitate transportation and storage of the canoe.

BACKGROUND

Recently, there has been an increase in the number of people who enjoy using high performance personal light boats, for example, personal non-powered boats that are manually propelled by paddling. In particular, kayaks, which are designed to be used in strong currents or on white water rapids, are a traditional type of boat used in extreme water sports that are popular with young adventure and thrill seekers. Furthermore, even if not used in strong currents or on white water rapids, kayaks or canoes can be used as personal water leisure means that enable a user to move far into a calm river or lake or across bodies of water and enjoy fishing or hunting.

Typically, conventional personal small non-poweredboats such as kayaks or canoes are made of thermoformed plastics or glass fiber reinforced plastics (FRP) to form hard hulls or are manufactured by integrally fitting panels made of a hard material such as wood or plywood. Therefore, conventional boats are advantageous in that their safety (durability, water resistance, impact resistance) in water, the strength, and use convenience (control performance, directivity, speed, etc.) resulting from the high stability are excellent. However, such a conventional boat is problematic in that the boat is heavy and production cost thereof is high. In addition, even though the boat is satisfactorily designed such that it can be effectively operated on water, it is difficult to transport the boat to water and store it when not used because of a large size.

Technical efforts to overcome the above problems are classified into the following three categories.

First, as a representative effort that has been widely used before, a boat having a separable structure was proposed. In detail, a frame of a kayak or canoe body includes a plurality of elements (boards, wires, etc. made of wood, metal or synthetic resin or the like) that can be separably assembled with each other by fasteners or connectors. Furthermore, a separate flexible waterproof hull covers the assembled frame. Such a structure for boats is called a skin on frame structure.

Conventional techniques pertaining to this category were in U.S. Pat. Nos. 4,274,170, 4,702,193, 4,841,899, 5,680,828, 5,964,964, and 6,367,405.

Such conventional personal boats pertaining to the first category include a hull that is made of flexible waterproof material and is removably coupled to a separably assembled frame to cover the frame. Thus, compared to traditional integrated boats, these conventional personal boats are advantageous in that transportation and storage thereof are facilitated. However, in the case of most of these conventional personal boats, the number and kind of elements constituting a frame are excessively increased, and the assembly structure of the frame is complex. In addition, configurations of connectors or the like for connecting the elements of the frame to each other are complex. It takes a comparatively long time to assemble or disassemble the frame, and there is a need for separate tools. Furthermore, since the hard frame and the flexible hull are made of different materials, the coupling (integration) therebetween is incomplete. Moreover, portions of the hull to which water pressure is applied are curved toward the interior of the boat because the strength of the hull is lower than that of the frame. The curved portions increase frictional resistance to water, thus reducing the performance of the boat in water. Furthermore, the curved portions reduce the strength of the hull, so that the hull may be easily torn when it collides with a sharp rock or the like.

Techniques pertaining to a second category refer to inflatable boats, which are shaped by injection of air. A representative example pertaining to this category was proposed in U.S. Pat. No. 6,065,421 (title: INFLATABLE KAYAK, 2000) invented in common by Clayton Forbes Haller and Charles Prior Hall.

In this technique, the kayak can be markedly reduced in volume and length when it is stored. The basic weight of the kayak can be also reduced. Furthermore, the kayak is designed such that it is easy to inject or discharge air into or from the kayak body. However, since the external shape of the boat is formed by injecting air thereinto, it is difficult to make not only a bow part of the boat but also a stem part be sharp and streamlined. Thus, water resistance applied to the boat is increased, whereby the basic performance of the boat is reduced. Given this, studies on this technique are not actively being conducted.

Techniques pertaining to a second category refer to techniques of: assembling body panels with each other using fasteners to form a boat without using a separate frame for the boat; forming a boat body by means of folding one piece of panel with a film-shaped retainer used to retain the shape of the boat formed by folding the panel; or forming a boat by means of folding a single thin hard panel having a predetermined flexibility, i.e., a light and high-strength synthetic resin corrugated sheet, which will be described in detail later herein, in a similar manner to that of paper folding.

Techniques pertaining to this third category were proposed in U.S. Pat. No. 4,574,725 (title: COLLASIBLE BOAT, 1986) invented by Dennis Dowd, U.S. Pat. No. 4,706,597 (title: SEAMLESS FOLDABLE BOAT, 1987) invented by Frank M. Fl gone, U.S. Pat. No. 4,911,095 (title: COLLAPSIBLE BOAT WITH REMOVABLE TRANSOM PANEL, 1990) invented by Alex R. Kaye, U.S. Pat. No. 6,006,691 (title: KNOCK-DOWN BOAT ASSEMBLY, 1999) invented by Stephen E. Wilce, U.S. Pat. No. 6,615,762 (title: FOLDABLE BOAT WITH LIGHT WEIGHT HULL CONSTRUCTION SYSTEM, 2003) invented by Stephen E. Wilce, and U.S. Pat. No. 8,316,788 (title: COLLAPSIBLE KAYAK, 2012) invented by Anton Michael Willis.

Among the techniques pertaining to the third category, there is a need for US patent techniques of the last two cases to be described in more detail with regard to the foldable canoe according to the present invention.

First, the technique proposed in the technique of U.S. Pat. No. 6,615,762 has several significant technical characteristics different form the other conventional techniques in the foldable boat field. It is that the body of the boat is made of a thin corrugated sheet with a thickness ranging from 5 mm to 6 mm, i.e., marketed as brand name HI.about.CORE®COROPLAST™, COREX, PLASTIC-CORE®, BIPLEX, etc., formed by extruding ultralight thin hard material, that is, high-strength polyethylene, high-density plastic or the like without a reduction in formability, foldability, and strength. In detail, as shown in FIG. 27*d*, a resin corrugated sheet CS used in this technique is a corrugated sheet that includes: a pair of panels 56 which are arranged parallel to each other with a predetermined distance therebetween to form front and rear surfaces; and a plurality of spacers 57 that perpendicularly connect the panels 56 to each other. Such a synthetic resin corrugated sheet was already known in other industrial fields, for example, as being widely used as the material of a box for packing objects, e.g., a moving box. Although U.S. Pat. No. 6,615,762 does not includes the ultralight corrugated sheet itself used as the material of a boat in claims, it proposed use of the corrugated sheet as the material of a disassemblable boat based on the facts that the corrugated sheet is neither affected by water, nor corrodes or rusts, and is excellent in impact resistance, penetration resistance, and weatherproofness providing resistance to severe external environment conditions, etc.

As shown in FIGS. 27*a* through 27*d*, in this technique, the boat body includes a plurality of individual corrugated sheets CS1 that are designed in predetermined shapes, and each of which has several folding lines 50. When the boat is assembled, the corrugated sheets CS1 are appropriately folded along the folding lines 50 and are arranged. The corrugated sheets are thereafter coupled to each other by screws with annular ribs R interposed between the lateral opposite ends of the corrugated sheets, thus forming the body of the kayak boat as shown in FIG. 27*a*. Unlike the existing techniques, in the technique of U.S. Pat. No. 6,615,762, each folding line on which the corrugated sheet is folded functions as a living hinge such that even after the sheet is repeatedly folded and unfolded around the folding line, it is prevented from being broken off. Therefore, this technique does not require a separate hinge. Furthermore, physical processes for forming the corrugated sheet, i.e., cutting a predetermined unit panel, boring holes such as screw coupling holes having various sizes in the panel, and pressing the panel to form a folding line, can be conducted at the same time, for example, by a single pressing process. Consequently, this technique is evaluated as being able to markedly enhance the productivity.

With regard to use of a high-strength ultralight synthetic resin corrugated sheet as the material for foldable boats, the technique of U.S. Pat. No. 6,615,762 is known as being the first in the world. Furthermore, this technique provides secondary effects of facilitating printing on the outer surface of a hull of the boat.

Meanwhile, in the same manner as the technique of U.S. Pat. No. 6,615,762, the technique of U.S. Pat. No. 8,316,788 uses a synthetic resin corrugated sheet as the material for boat bodies and thus has the same technical effects resulting from use of the synthetic resin corrugated sheet. However, unlike the technique of U.S. Pat. No. 6,615,762 in which the boat body is formed by joining the several separated corrugated sheets with each other, a single synthetic resin corrugated sheet is used, and folding lines are formed on the sheet designed such that the sheet can be formed in a boat shape by folding the sheet along the folding lines. That is, the single synthetic resin corrugated sheet has only to be folded or unfolded in a similar manner to that of paper folding to form a boat or make it become a package form for storage.

Formed in the synthetic resin corrugated sheet, the folding lines of the technique of U.S. Pat. No. 8,316,788 also function as living hinges, which are not broken even after they are repeatedly bent along the folding lines. Because the single corrugated sheet is used to form a boat body, this technique has not only the effects of the technique of U.S. Pat. No. 6,615,762 but also effects of a reduction in the number of elements and facilitation of assembly and disassembly processes.

However, the crucial point to note is that both the techniques of U.S. Pat. Nos. 6,615,762 and 8,316,788 pertain to kayaks rather than canoes. Although kayaks and canoes are similar in that both are personal non-powered small boats, it should be noted that there is a great difference in mechanical structure therebetween.

In more detail, kayaks are configured such that a side bottom panel that is immersed in water and brought into contact with water is integrally connected to an upper deck that substantially horizontally covers the upper ends of left and right side panels and does not come into contact with water. A tubular closed space defined by the side bottom panel and the upper deck becomes a cockpit in which a user sits. Generally, a coaming or the like is provided for preventing water from entering the cockpit through an opening of the cockpit, which is formed in an approximately central portion of the upper deck.

Unlike such kayaks, canoes typically have an open top boat structure, and have a non-tubular shape, including only a side bottom panel without a separate upper deck.

To make a boat manufactured by shaping a thin planar sheet using a given amount of material (to form a predetermined cross-sectional area and surface area) have a mechanically stable structure strong enough to resist to external force, the boat must be shaped such that the section performance thereof (particularly, geometrical moment of inertia) are increased. With regard to manufacture of a boat using a thin synthetic resin corrugated sheet, in the case of kayaks having a closed tubular body structure, the geometrical moment of inertia is comparatively large so that the resistance to external force can be easily increased. However, in the case of canoes generally having an open top structure, the geometrical moment of inertia thereof is smaller than that of the kayaks. Thus, it is not easy to manufacture an open top canoe by means of folding a thin sheet. As the result of tests, for example, if an open top canoe having a length ranging from 3 m to 4 m and a central width of about 1 m is formed by folding a thin synthetic resin corrugated sheet, the shape of a boat is not satisfactorily formed or it is difficult to retain the shape of a side panel moving limply because the section performance as a canoe boat is very low although the physical (mechanical) properties, such as strength, durability, etc., of the synthetic resin corrugated sheet are excellent.

Due to these reasons, both the inventor of U.S. Pat. No. 6,615,762 and the inventor of U.S. Pat. No. 8,316,788 would have thought that kayaks having a longitudinal tubular body structure are easier to manufacture using a light and thin synthetic resin corrugated sheet having a high strength. This aspect can be easily verified in that: in U.S. Pat. No.

6,615,762, a tubular structure is formed by enclosing the circumferences of the annular ribs with panels forming the boat body; in U.S. Pat. No. 8,316,788, claim 1 includes, as an essential configuration, forming a tubular shape by folding left and right panels along a longitudinal axis and joining opposite edges of left and right panels to each other; and another independent claim 22 includes, as an essential configurations integrally forming the keel of the kayak (keel: a long and large member provided parallel to a center axis on the bottom of a boat so as to support the hull of the boat), the hull (the side bottom panel), and the deck (the upper cover panel).

Therefore, there is a need for a technique that can construct a body of a boat by folding a single high-strength thin synthetic resin sheet in a similar manner to that of paper folding, and that can construct an open top (deckless) boat, i.e., a canoe, having a mechanically stable structure without the side bottom panel moving limply. The present invention is provided to satisfy this need.

SUMMARY

The above and other needs are met by a foldable canoe. In a first aspect a foldable canoe includes: a hull having a bow portion, a stern portion, a port side, a starboard side, and a gunwale formed around the hull, the hull formed of an elongate sheet of synthetic material having a plurality of folds including at least one longitudinal fold along a length of the sheet and one or more horizontal folds formed across a width of the sheet, wherein the hull is configured to be folded into a stored configuration along the at least one longitudinal fold and one or more horizontal folds of the elongate sheet; one or more ribs installed across a width of the hull, the one or more ribs removably installed inside the hull for maintaining the elongate sheet in a shape of the hull; a gunwale cap including a channel shaped to removably fit over the gunwale of the hull, the gunwale cap formed of a plurality of adjoining gunwale sections, wherein each of the plurality of adjoining gunwale sections is removably secured to adjacent gunwale sections. In a deployed configuration the plurality of adjoining gunwale sections are joined such that the gunwale cap maintains a shape of the gunwale of the hull, and wherein in a stored configuration the plurality of adjoining gunwale sections are separated such that the gunwale cap is folded into a stowed configuration.

In one embodiment, one or more of the plurality of gunwale sections of the gunwale cap further include: a hollow pin extending from a first end of the gunwale section toward an adjacent gunwale section and a bore formed in a second end of the gunwale section shaped to receive the hollow pin extending from an adjacent gunwale section. In another embodiment, the foldable canoe further includes a wire extending through hollow pin and the bore of the plurality of gunwale sections for connecting the plurality of gunwale sections when the plurality of gunwale sections are separated. In yet another embodiment, the foldable canoe further includes stoppers located at opposing ends of the wire and a wire adjuster adjustably located on the wire between one of the stoppers and one of the gunwale sections, wherein the wire adjuster is adjustable along a length of the wire for tightening the wire to maintain the plurality of gunwale sections in a joined configuration.

In one embodiment, one or more of the plurality of gunwale sections of the gunwale cap further include: a connecting rod extending from a first end of the gunwale section toward an adjacent gunwale section and a connecting rod bore formed in a second end of the gunwale section and shaped to receive the connecting rod of an adjacent gunwale section. The connecting rod and connecting rod bore form a keyed connection such that adjoining gunwale sections may be rotatively secured to one another.

In another embodiment, the connecting rod further includes a connecting rod head having a flattened portion formed thereon, the connecting rod bore further comprising a pin extending across a width of the connecting rod bore, wherein the connecting rod head and pin formed a keyed connection between adjacent gunwale sections.

In yet another embodiment, the foldable canoe further includes: a pair of opposing keyholes mounted on an inner surface of the hull, each of the keyholes comprising a spring formed adjacent the keyholes; a pair of bolt heads extending from ends of the one or more ribs, the bolt heads shaped to be inserted through at least a portion of the keyhole such that the spring contacts the bolt head to resist releasing the bolt head from the keyhole.

In one embodiment, the foldable canoe further includes an expander located within the hull at one of the bow portion and stern portion of the hull for maintaining a shape of the hull, the expander including a pair of opposing upright plates mounted on an interior of the hull and a spreader plate extending between the pair of opposing upright plates. In another embodiment, the spreader plate is hingedly attached to one of the pair of opposing upright plates. In yet another embodiment, the foldable canoe further includes a pair of reinforcement plates located between each of the pair of opposing upright plates and the hull.

In one embodiment, the foldable canoe further includes a pair of oar locks, each of the oar locks including: an oar lock plate mounted to the hull adjacent the gunwale, the oar lock plate each at least one keyhole formed through oar lock plate; an oar lock body including at least one oar lock post extending from the oar lock body and shaped to engage the at least one key hole formed through the oar lock plate; an oar pin pivotally associated with the oar lock body for receiving an oar; an oar pin cap removably associated with the oar pin for securing an oar on the oar pin.

In another embodiment, the foldable canoe further includes one or more straps attached along the gunwale for securing the gunwale cap to the gunwale.

In yet another embodiment, the foldable canoe further includes a foldable seat removably installed on the hull, the foldable seat including: a seat cushion; a foldable seat base attached to a bottom of the seat cushion, the foldable seat base configurable in an open position wherein the seat base supports the seat cushion on a floor of the canoe and a stowed position wherein the seat base is folded against the seat cushion; at least one clip located adjacent the bottom of the seat cushion for engaging an upper portion of the rib; and a seat hook located on the seat base for engaging a lower portion of the rib.

In one embodiment, the foldable seat further includes a seat wire extending through the seat base for pulling the seat base into the open position, wherein the seat hook is slidably attached to the seat wire. In another embodiment, the foldable seat further includes at least one spring positioned between the seat cushion and the foldable seat base such that the foldable seat base is biased towards the open position.

In a second aspect, a foldable canoe includes: a hull having a bow portion, a stern portion, a port side, a starboard side, and a gunwale formed around the hull, the hull formed of an elongate sheet of synthetic material having a plurality of folds including at least one longitudinal fold along a length of the sheet and one or more horizontal folds formed across a width of the sheet, wherein the hull is configured to be folded into a stored configuration along the at least one longitudinal fold and one or more horizontal folds of the elongate sheet; one or more ribs installed across a width of the hull, the one or more ribs removably installed inside the hull for maintaining the elongate sheet in a shape of the hull; a gunwale cap including a channel shaped to removably fit over the gunwale of the hull, the gunwale cap formed of a plurality of adjoining gunwale sections having a hollow pin extending from a first end of the gunwale section toward an adjacent gunwale section and a bore formed in a second end of the gunwale section shaped to receive the hollow pin extending from an adjacent gunwale section. Each of the plurality of adjoining gunwale sections is removably secured to adjacent gunwale sections. In a deployed configuration the plurality of adjoining gunwale sections are joined such that the gunwale cap maintains a shape of the gunwale of the hull, and wherein in a stored configuration the plurality of adjoining gunwale sections are separated such that the gunwale cap is folded into a stowed configuration.

In a third aspect, a foldable canoe includes: a hull having a bow portion, a stern portion, a port side, a starboard side, and a gunwale formed around the hull, the hull formed of an elongate sheet of synthetic material having a plurality of folds including at least one longitudinal fold along a length of the sheet and one or more horizontal folds formed across a width of the sheet, wherein the hull is configured to be folded into a stored configuration along the at least one longitudinal fold and one or more horizontal folds of the elongate sheet; one or more ribs installed across a width of the hull, the one or more ribs removably installed inside the hull for maintaining the elongate sheet in a shape of the hull; a gunwale cap including a channel shaped to removably fit over the gunwale of the hull, the gunwale cap formed of a plurality of adjoining gunwale sections having a connecting rod extending from a first end of the gunwale section toward an adjacent gunwale section and a connecting rod bore formed in a second end of the gunwale section and shaped to receive the connecting rod of an adjacent gunwale section. The connecting rod and connecting rod bore form a keyed connection such that adjoining gunwale sections may be rotatively secured to one another. In a deployed configuration the plurality of adjoining gunwale sections are joined such that the gunwale cap maintains a shape of the gunwale of the hull, and wherein in a stored configuration the plurality of adjoining gunwale sections are separated such that the gunwale cap is folded into a stowed configuration.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

FIGS. 45A-44D illustrate a rotatably coupled gunwale cap according to one embodiment of the present disclosure;

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
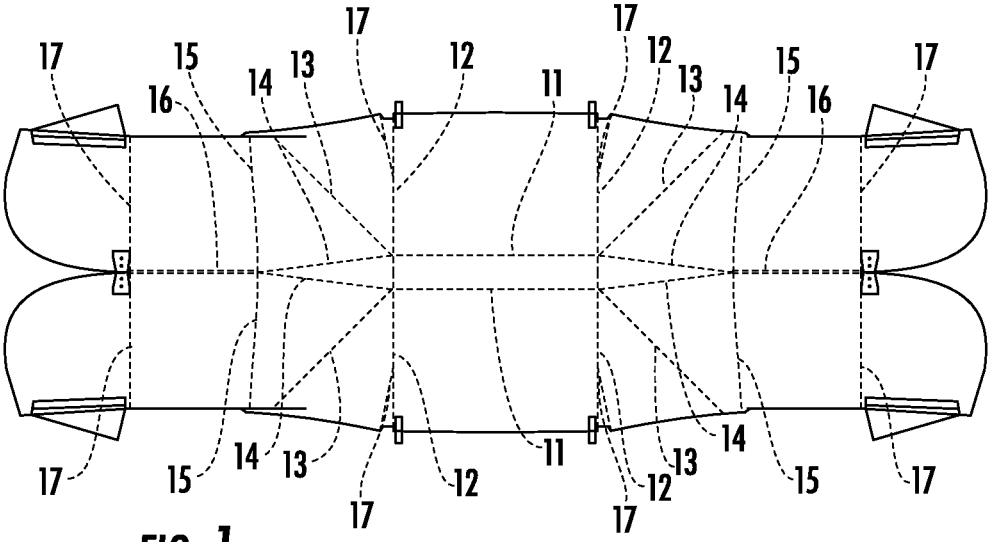
FIG. 1 is a development view (top plan view) of a canoe according to the present invention.
Figure 2:
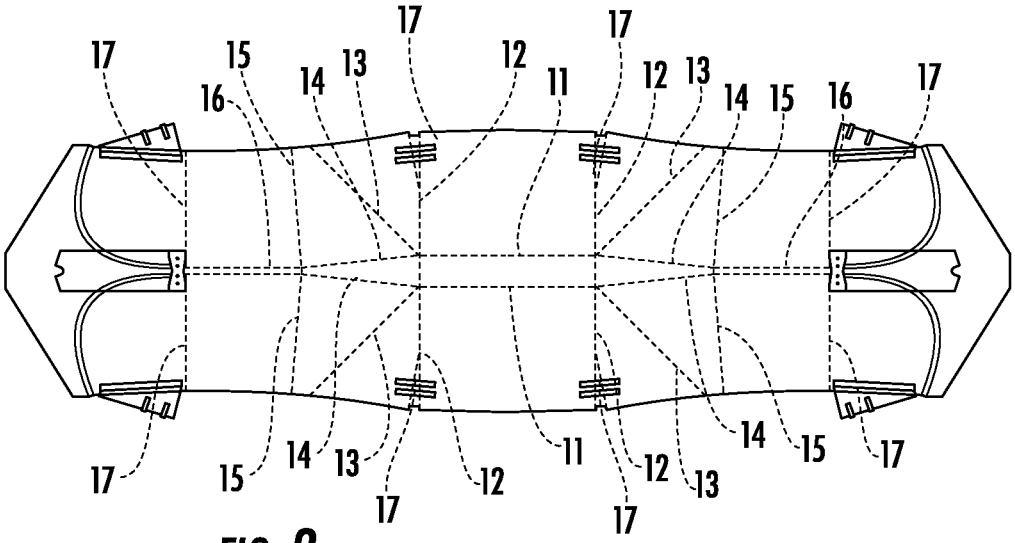
FIG. 2 is a development view (bottom plan view) of the canoe according to the present invention.
Figure 3:
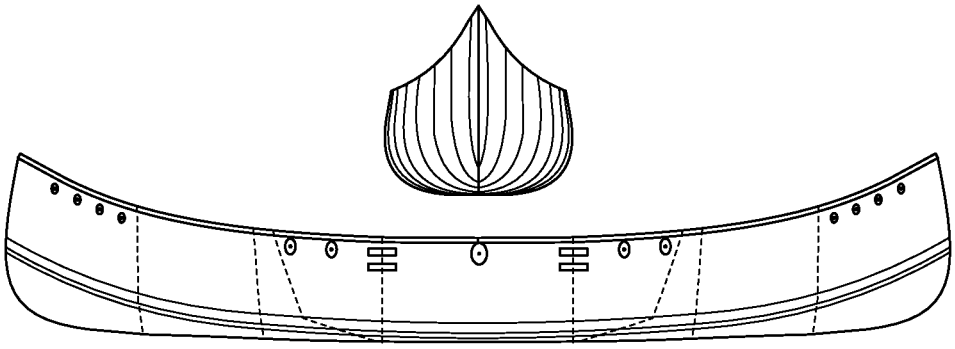
FIG. 3 is a side view illustrating the assembled canoe according to the present invention.
Figure 4:
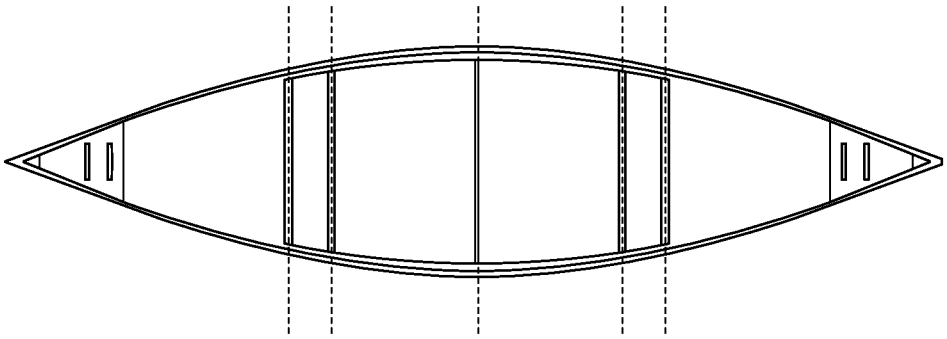
FIG. 4 is a plan view illustrating the assembled canoe according to the present invention.

FIG. 1 is a development view (top plan view) of a canoe according to the present invention. FIG. 2 is a development view (bottom plan view) of the canoe according to the present invention. FIG. 3 is a side view illustrating the assembled canoe according to the present invention. FIG. 4 is a plan view illustrating the assembled canoe according to the present invention.

As shown in FIGS. 1 through 4, a foldable canoe according to the present invention is made of a planar synthetic resin rigid sheet having a predetermined flexibility without use of a separate structural frame. The canoe is configured such that the sheet can be folded along folding lines formed in an inner surface of the sheet so as to form the canoe. After use of the canoe, the sheet can be completely folded along the folding lines to form a compact structure, thus reducing the volume and length of the canoe, thereby facilitating transportation and storage of the canoe.

For instance, the synthetic resin sheet used in the present invention may be a thin corrugated sheet, with a thickness ranging from 5 mm to 6 mm, i.e., marketed as brand name HI.about.CORE®COROPLAST™, COREX, PLASTICCORE®, BIPLEX, etc., formed by extruding high-strength polyethylene, high-density plastic or the like, in the same manner as that of a corrugated sheet introduced in U.S. Pat. No. 6,615,762. The canoe according to the present invention made of such synthetic resin corrugated sheet is mere 18 kg to 22 kg in weight when the length thereof ranges from 4 m to 5 m and the width thereof ranges from 1 m to 1.5 m.

Meanwhile, any synthetic resin sheet, as well as the above-mentioned corrugated sheet, can be used in the present invention so long as a hinge line functioning as a living hinge, which is not broken even if it is repeatedly bent, can be formed in the surface of the sheet. Alternatively, the foldable sheet for the canoe may include a plurality of pieces that are joined with each other by waterproof tape.

In FIG. 1, a solid line is a cutting line, and a dotted line is a folding line. As can be understood from FIGS. 1 and 2, the deployed synthetic resin corrugated sheet substantially has a symmetrical shape with respect to both a front-rear (longitudinal) direction and a left-right (lateral) direction. This front, rear, left and right symmetrical shape is proposed merely as an exemplary embodiment of the present invention, and the present invention is not limited to this. As needed, the canoe may be configured such that it has a symmetrical shape in a left-right (lateral) direction while having an asymmetrical shape in a front-rear (longitudinal) direction, for example, differing in shape between the bow and the stem. This modification must be regarded as falling within the bounds of the present invention so long as such a difference in shape between the bow and the stem complies with the spirit of the present invention that is based on the specification of the present invention.

Figure 10:
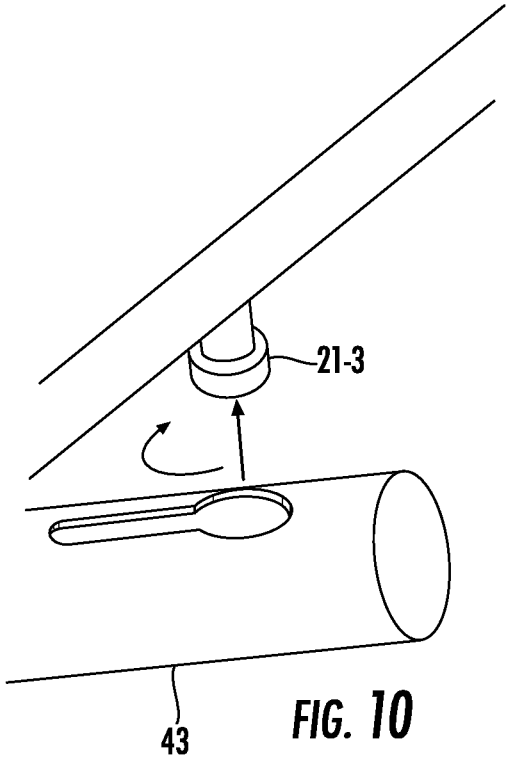
FIG. 10 is a partially-enlarged perspective view showing a configuration for coupling a rib to a gunwale of the canoe.

In FIG. 1, reference numerals 1 to 7 denote panel parts that are partitioned by the folding lines. Reference numerals 11 to 17 are numerals for indicating the respective folding lines. Reference numerals 21 to 39 (with branching numerals) are elements that are attached to the canoe boat when the canoe boat is manufactured with the corrugated sheet. In detail, numeral 21 denotes a protruding bolt head or head pin (refer to FIG. 10 showing an enlargement thereof) that is fixed on the surface of the corrugated sheet so as to mount a rib to the corrugated sheet. Reference numeral 22 denotes removable small deck parts that are respectively attached to front and rear parts (bow and stem) of the canoe. Reference numeral 28 denotes buckles that are installed on respective opposite sides of the canoe panel to facilitate a last closing operation of a process of folding the canoe panel to form a packed state (refer to FIG. 25). Reference numeral 29 denotes gunwales that respectively form left and right edges of the boat.

In FIG. 2, reference numeral 23 denotes waterproof cloth sheets that are provided for watertightness of the stem and bow parts of the canoe, and each of which covers both left and right cut-shaped symmetrical parts of the stem or bow part. When a zipper is closed, each waterproof cloth sheet is contracted inside the zipper and housed in the stem or bow part of the boat.

Reference numeral 24 denotes a zipper that closes curved edges of cut panels of the stem or bow part such that the curved edges engage with each other. In the present invention, the zipper may be replaced with Velcro tape, a buckle, a snap button or the like.

Reference numeral 25 denotes an outermost elastic rubber cover that covers the zipper of the stem or bow part so as to prevent the zipper from being exposed to the outside, strengthens the coupling force of the zipper and thus prevents the zipper from undesirably opening, and protects the corresponding stem or bow part from shock when the curved part of the stem or bow part having a tapered shape collides with an external object. In addition, the rubber cover 25 functions to enhance waterproof performance. As shown in the drawing, a first end of the rubber cover 25 is fixed to a lower surface of an outer central portion of the stem (or bow) part of the panel, and a second end thereof is a free end. After the stem (or bow) part of the canoe has been completely assembled to form a tapered edge shape, the second end (the free end) of the rubber cover 25 is elastically extended upward such that the rubber cover 25 covers the tapered curved edge of the stem (or bow) part, and then is operatively hooked to a protruding ring (not shown) or the like of the stem (or bow) part so that the rubber cover 25 can be elastically maintained tight. Furthermore, the rubber cover 25 may be appropriately selected in a color to be an aesthetic point of the appearance of the canoe.

Hereinafter, the configuration of the stem or bow part for operatively and watertightly opening or closing the curved edges of the left and right cut panels using the waterproof cloth sheet 23 and the zipper 24 will be described in more detail with reference to FIG. 26.

Figure 26:
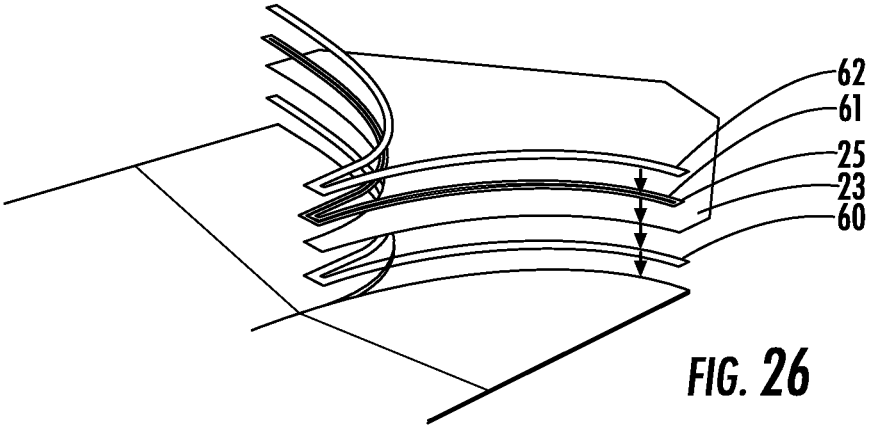
FIG. 26 is an exploded perspective view showing a waterproofing configuration provided on the stem (or bow) part of the foldable canoe according to the present invention.
Figure 27A:
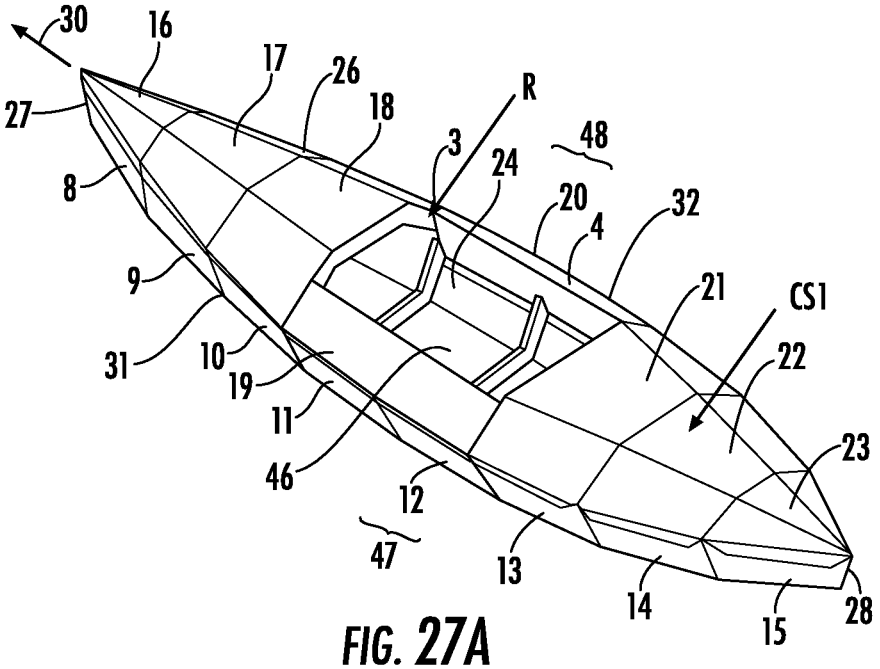
FIG. 27 is a representative view of U.S. Pat. No. 6,615,762 that proposes a kayak configured such that a plurality of synthetic resin corrugated sheets each designed in a predetermined shape are longitudinally and successively connected to each other with ribs interposed therebetween so that a floor board, both side panels and an upper deck are integrally formed.
Figure 27B:
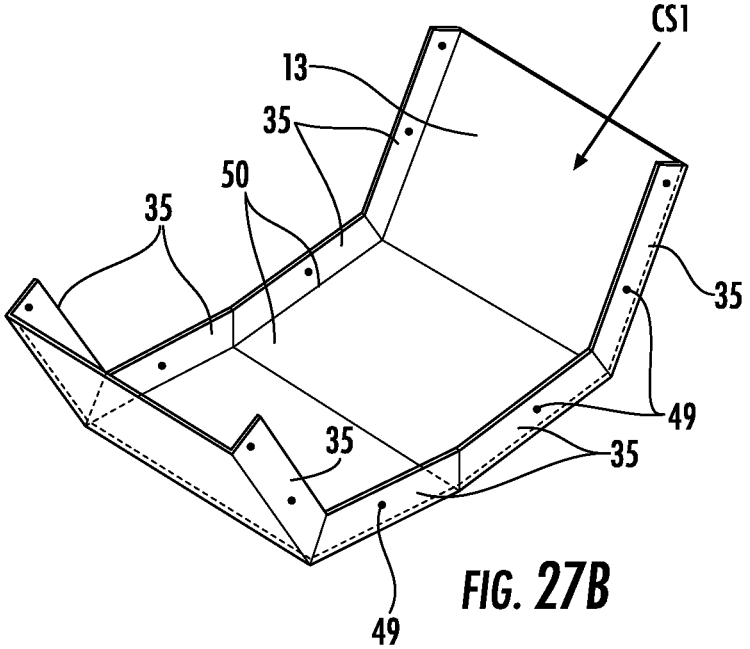
Figure 27C:
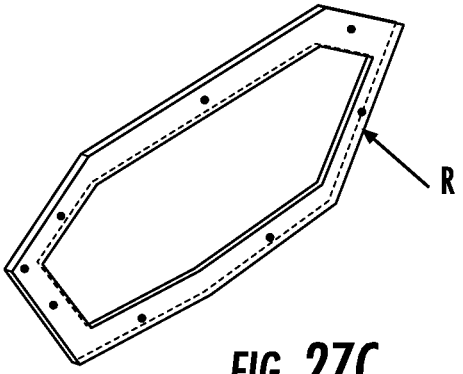
Figure 27D:
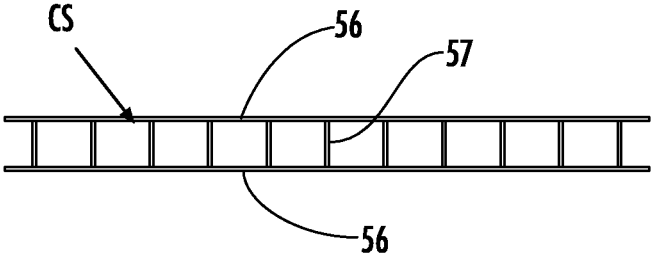

FIG. 26 is an exploded perspective view showing a waterproofing configuration provided on the stem (or bow) part of the foldable canoe according to the present invention. A waterproof rubber band 60 that is cut to have a shape corresponding to the curved edges of the left and right cut panels is attached along the curved edges of the left and right cut panels by adhesive (not shown). The perimeter of the waterproof cloth sheet 23 having a predetermined area is attached to an upper surface of the waterproof rubber band 60 by adhesive (not shown). The zipper 24 is attached to the perimeter of the waterproof cloth sheet 23 by adhesive (not shown) along the curved edges of the left and right cut panels. To integrally join the left and right panel parts 7, the waterproof rubber band 60, the waterproof cloth sheet 23, and the zipper 24 with each other, a plurality of clamps or stapler pins 61 are driven into the zipper 24 along the adhered portions of the above elements. The clamps or stapler pins 61 can further enhance the coupling force of the elements to the left and right panel parts of the bow part and the waterproof performance of the waterproofing configuration. Reference numeral 62 denotes a finish cover that covers the clamps or stapler pins 61 driven into the zipper 24 and emphasize the curved shape of the bow part. The finish cover is attached to the upper surface of the zipper by adhesive (not shown).

One of the objects of the present invention provides a means for: making the bow and stem parts of the canoe as sharp as possible (such that the canoe is tapered the front and rear parts thereof) so that in the same manner as a conventional usual canoe produced by the typical manufacturing method, a beautiful bow or stem line of the canoe can be maintained, and resistance between the canoe and water can be hydrodynamically reduced as much as possible to enhance the moving performance (with regard to straightness, a driving speed, etc.) of the canoe; and enhancing the waterproofing performance of the bow and stem parts of the canoe that are most prone to water penetration and each of which is divided into two parts to be joined with each other when the single corrugated sheet is folded to form the canoe. This object of the present invention can be effectively achieved by the configuration of the curved edges of the cut panels, the operative opening and closing configuration of the zipper, and the configuration in which multi-layers of essential elements 23, 24, and 28 are firmly and integrally coupled to the edges of the curved parts of the cut panels.

Referring again to FIG. 2, reference numeral 26 denotes buckles for coupling a pair of divided decks 22, which are respectively provided on left and right sides of the canoe panel, to each other when the canoe is assembled.

The present invention is to provide a three-dimensional canoe that can be formed by folding a single planar panel. Particularly, to appropriately form a continuous curved gunwale line that forms a smooth streamlined shape when the canoe is assembled, approximately triangular notches or depressions are formed in each side panel part. Reference numeral 27 denotes a buckle provided around each notch or depression for use in adjusting the longitudinal length of an upper gunwale line of a side surface of the canoe. The triangular notch or depression is closed by tightening the buckle 27 so that the gunwale line can be reduced in length while forming a smooth streamlined shape. A zipper, Velcro tape, etc. may be substituted for the buckle 27.

Figure 5:
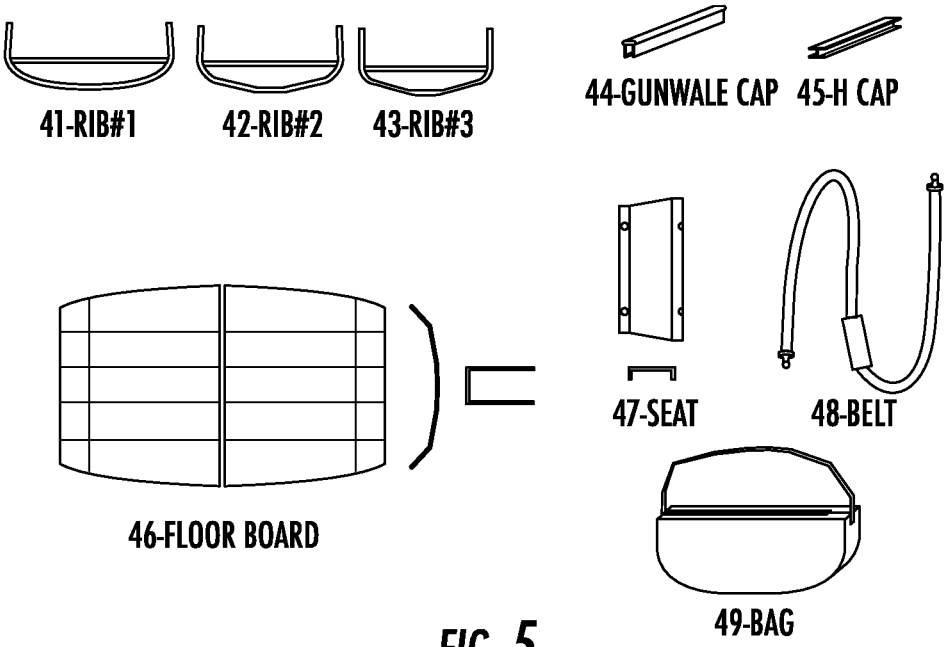
FIG. 5 is a view showing both elements for retaining the shape of the canoe after the canoe has been assembled and elements for packing the folded canoe.

FIG. 5 is a view showing both elements for retaining the shape of the canoe after the canoe has been assembled and elements for packing the folded canoe. Reference numeral 41 denotes a U-shaped first rib RIB#1 (a single rib, coupled to a bolt head 21-1 of FIG. 1). Reference numeral 42 denotes U-shaped second ribs RIB#2 (two ribs, each coupled to a bolt head 21-2 of FIG. 1). Reference numeral 43 denotes U-shaped third ribs RIB#3 (two ribs, each coupled to a bolt head 21-3 of FIG. 1). Installation of these ribs in the canoe is clearly illustrated in FIGS. 6, 9, 10, and 11.

In the present invention, the ribs are removably fixed on inner surfaces of left and right panels of the canoe. Such ribs conduct a pivotal role in retaining the streamlined shape (in which the degree with which the canoe is bulged is gently varied in the longitudinal direction of the canoe) of the canoe boat with respect to the lateral direction. Preferably, the size and shape of each U-shaped rib corresponds to the lateral size and shape of a corresponding portion of the canoe. However, the shapes, the installation positions, and the number of ribs may be changed depending on a design of the canoe without being limited to those of the above-mentioned exemplary embodiment.

Reference numeral 44 denotes a gunwale cap that is coupled to an upper end of the gunwale along the gunwale line. In the present invention, the gunwale cap conducts an important role along with the above-mentioned ribs in an aspect of retaining the smooth streamlined shape of the canoe for producing, by a means of bending a single sheet, an open top canoe, the geometrical moment of inertia of which is comparatively small, rather than producing a tubular kayak.

In detail, the gunwale cap 44 is a longitudinal member having comparatively high stiffness with a U-shaped cross-section. In this embodiment, a plurality of gunwale caps 44 is successively fitted over the gunwale along the gunwale line and also fitted over front edges of the above-mentioned left and right deck parts, thus reinforcing the gunwale, and making the gunwale line smoother (refer to FIGS. 12 and 13). Preferably, the lengths of the gunwale caps 44 are set in advance such that when the gunwale caps 44 are successively fitted over the gunwale 29 in the longitudinal direction, a portion at which the triangular notch or depression is tightened by the buckle 27 (this portion is a mechanically weak portion that is not integrated into a single body) is disposed in a medial portion of the corresponding gunwale cap.

Figure 12:
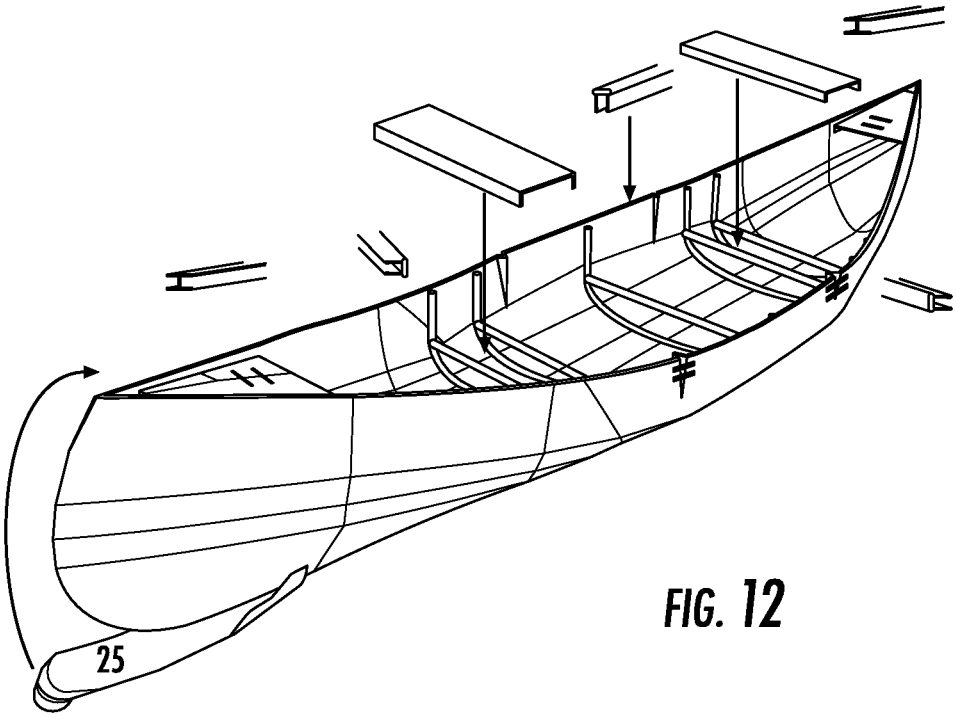
FIG. 12 is a perspective view showing installation configuration of elements for retaining the shape of the canoe when the canoe is assembled according to the present invention.
Figure 13:
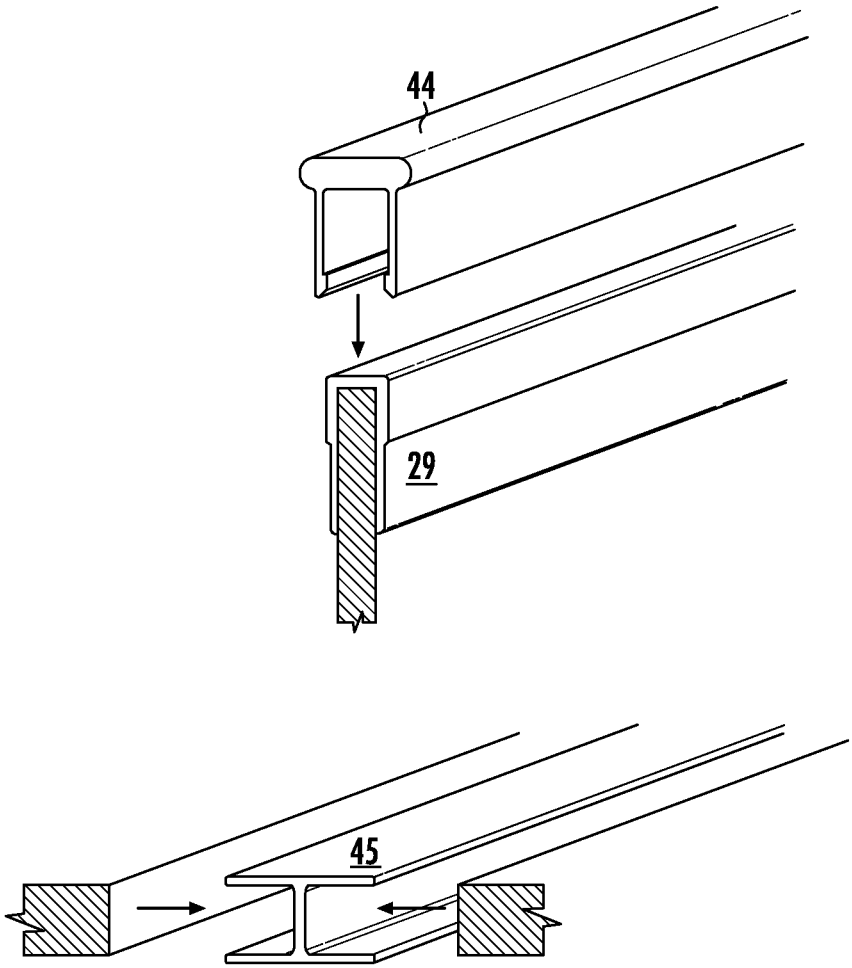
FIG. 13 illustrates a partial enlarged view showing a cap fitted over an upper end of a gunwale and a partial enlarged view showing configuration for installing a pair of small removable deck parts in each of the bow and stem parts of the canoe according to the present invention.

Reference numeral 45 denotes an H-cap. Referring to FIGS. 12 and 13, the H-cap 45 couples contact edges of two deck parts that are coupled to the inner surface of each of the bow and stem parts of the canoe boat when it is assembled, thus preventing the deck from being distorted. A contact edge of each deck part 22 is fitted between upper and lower flanges of the H-cap to a left or right surface of a web of the H-cap. The gunwale cap is fitted over the lateral front edges of the deck parts 22 (refer to FIG. 12). The deck parts 22 introduced in the present invention completely differ from the deck used to produce the kayak proposed in U.S. Pat. No. 8,316,788. The deck proposed in U.S. Pat. No. 8,316,788 is a body member (an element conducting a role for forming a tubular shape) that is formed by bending a panel, has a comparatively large area, and is integrated with other portions of the panel. However, the decks 22 introduced in the present invention are manufactured as separate elements, rather than being elements formed by integrally bending a portion of the corrugated sheet, and then are separately coupled to the corrugated sheet during the assembly process of the canoe. The decks 22 must be understood as subsidiary elements provided for preventing the left and right parts of the bow or stem part, which are coupled to each other by a zipper or the like, from being distorted or opened to the left and right sides.

Figure 23:
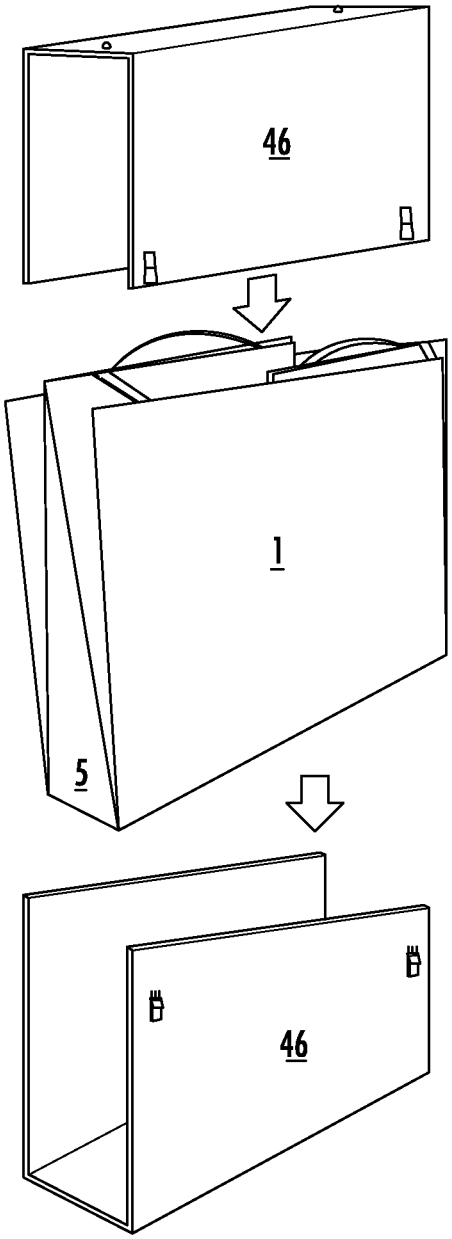
Figure 24:
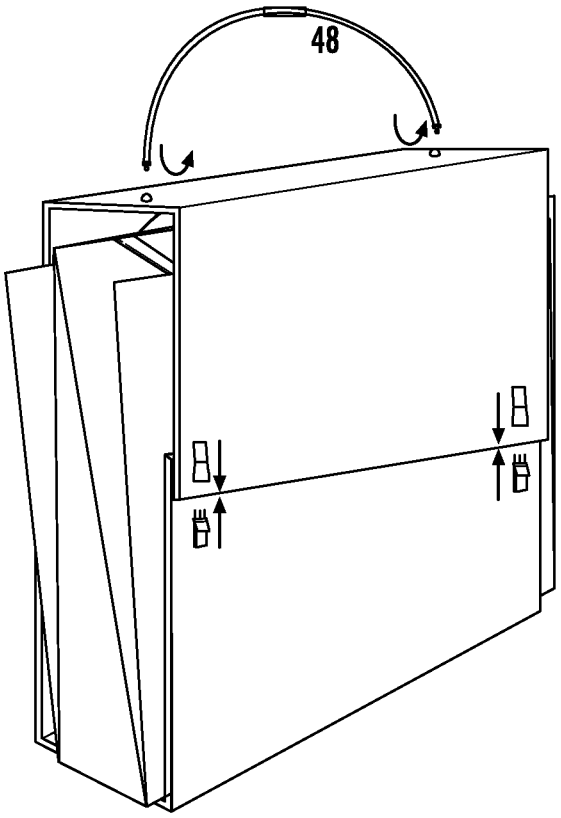
Figure 25:
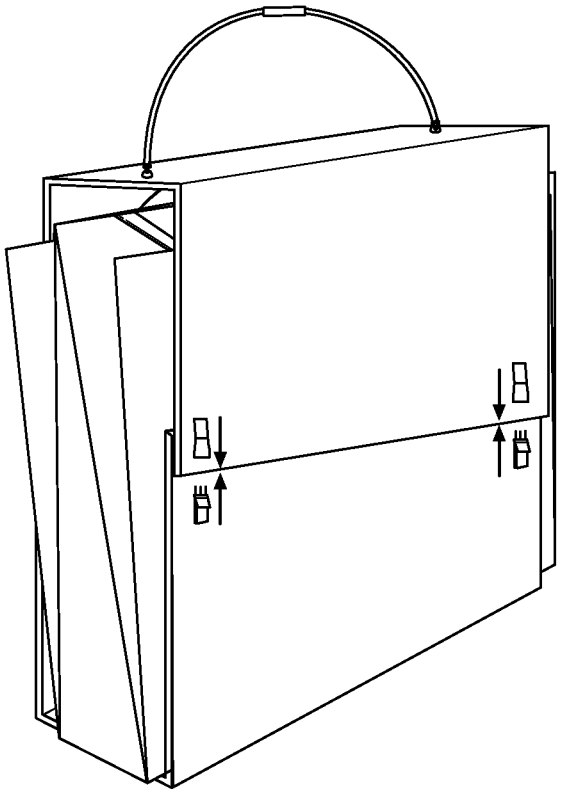

Reference numeral 46 denotes a floor board. In the present invention, two floor boards made of the same material as that of the corrugated sheet forming the canoe body are preferably provided. Furthermore, it is preferable that each floor board have folding lines for providing an appropriate curvature such that it comes into close contact with the bottom and portions of the side panels of the canoe. In the present invention, the floor boards are provided to mechanically reinforce the bottom of the canoe that is not only a portion of the canoe body to which the largest uplift water pressure from the outside is applied when the canoe is used but also is a portion of the canoe body to which the weight of a user who sits in the canoe is applied. Crossed over the bottom of the canoe in the lateral direction of the canoe, the floor boards 46 assist retaining the mechanical shape of the canoe body. In addition, the floor boards 46 function to increase the thickness of the bottom of the canoe that forms a loading space of the canoe, thus reinforcing mechanical stress (i.e., compressive stress or shear stress) of the bottom of the canoe. As shown in FIGS. 23 through 25, the floor boards 46 can also be used as packing members that can wrap the folded canoe body to form a compact shape when the canoe is stored after used. In terms of this, the floor boards 22 conduct an important role for achieving one of the objects of the present invention despite each having a simple shape, being made of the same material as that of the canoe body, and being needed in only a small number. After the floor board 46 is spread to be brought into close contact with the bottom of the canoe, the first rib 41 and the third ribs 43 are fitted into the canoe body at positions corresponding to the longitudinal opposite ends of the floor boards, and the second ribs 42 are installed such that they press the upper surfaces of the floor boards (refer to FIGS. 6 and 9). However, the positional relationship between the floor boards 46 and the ribs 41 through 43 is not directly related to the characteristics of the present invention and must be understood as being variable.

Figure 6:
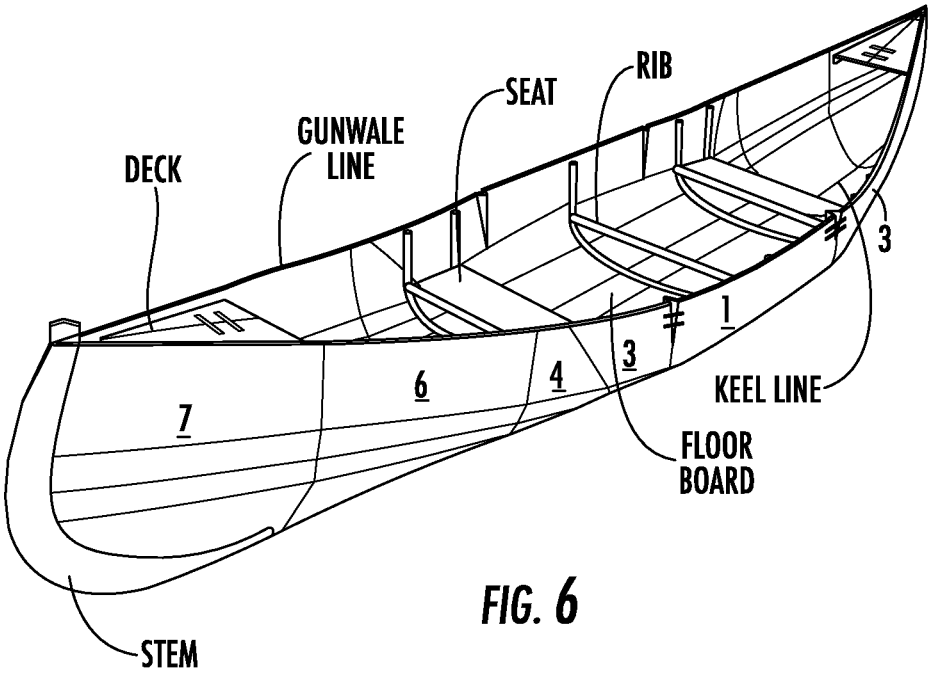
FIG. 6 is a perspective view illustrating the assembled canoe according to the present invention.

Reference numeral 47 denotes a seat on which the user sits. As shown in FIG. 6, the seat 47 is placed on the second and third ribs 42 and 43 and fixed thereto by a buckle (not shown).

Reference numeral 48 denotes a belt. When the floor board 46 wraps the canoe body in a package fashion to store the canoe, the belt 48 is connected to rings provided on the floor board 46 and thus can be used as a shoulder strap (refer to FIGS. 24 and 25).

Reference numeral 49 denotes a bag for storage of elements. That is, the bag 49 is used to store the ribs 41 through 43 and the gunwale caps 44.

FIG. 6 is a perspective view illustrating an exemplary embodiment of the assembled state of the canoe according to the present invention having the above-mentioned configuration. FIGS. 7 through 13 are views illustrating a process of constructing the canoe shown in FIG. 6. Hereinafter, the assembly process or assembly configuration of the foldable canoe according to the present invention will be described in more detail with reference to FIGS. 7 through 13.

Figure 7:
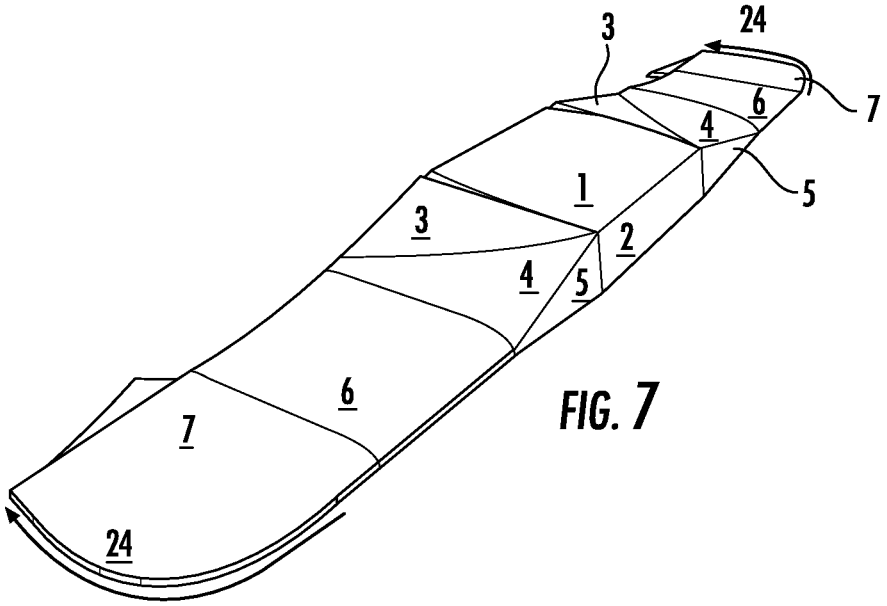
FIG. 7 is a perspective view illustrating an initial assembly process for forming the canoe from a development state that is substantially planar.
Figure 8:
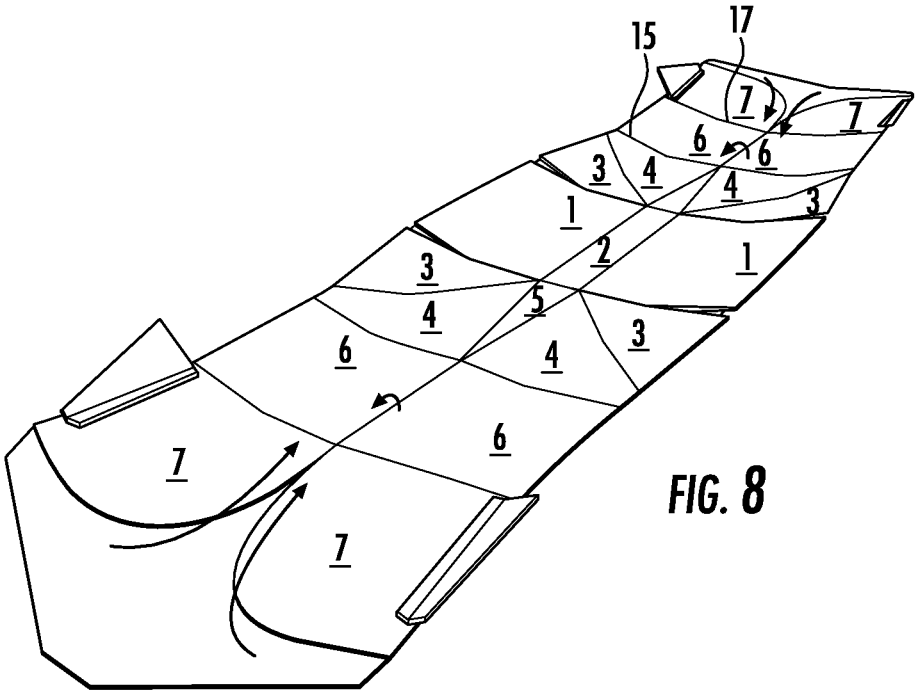
FIG. 8 is a perspective view illustrating a stem part zipped up.
Figure 9:
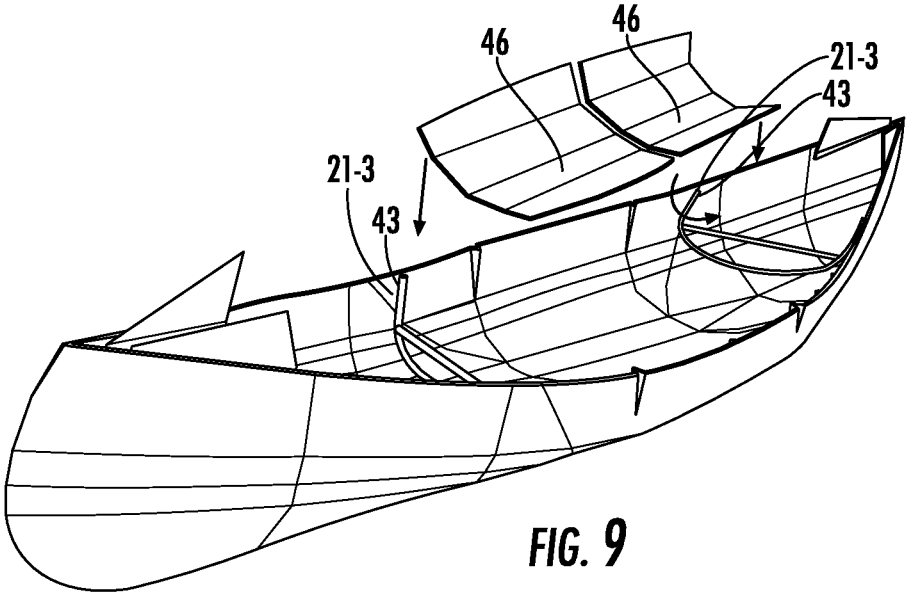
FIG. 9 is a perspective view showing a process of placing upright a lateral support fitted over heads of bolts.
Figure 11:
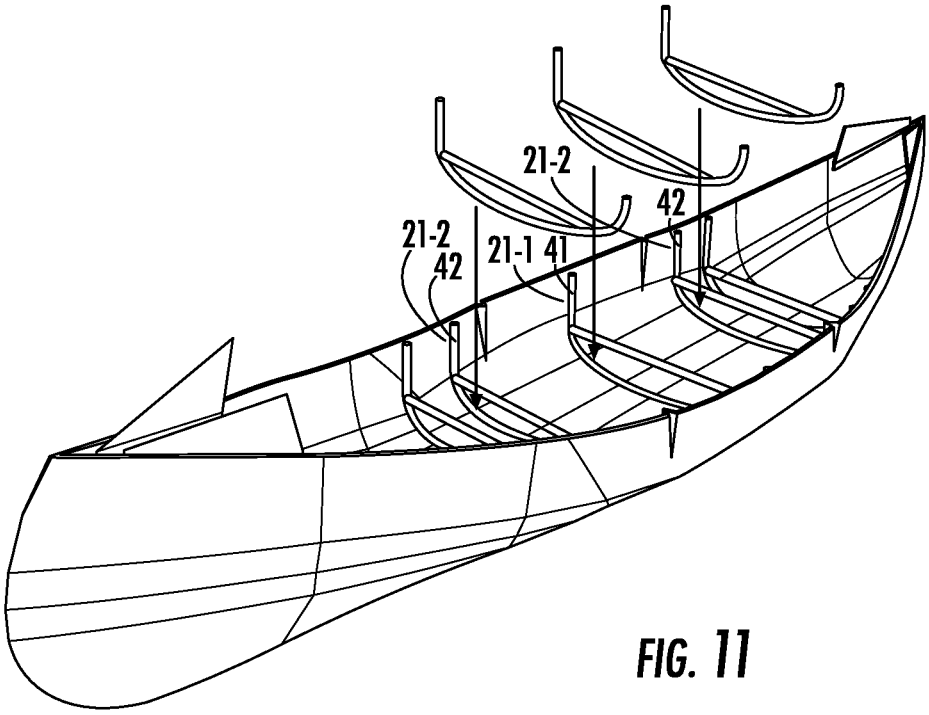
FIG. 11 is a perspective view illustrating a process of rotating ribs such that the ribs are placed upright on a floor board and thus reliably fastening the floor board to the bottom of the canoe.

FIG. 7 illustrates an initial stage of the assembly process. The sheet panel is longitudinally folded based on the central folding lines 11, 14, and 16. The waterproof cloth sheets 23 are thereafter folded and inserted into the canoe panel such that when the zipper is closed, the waterproof cloth sheets 23 are prevented from being caught by teeth of the zipper. FIG. 8 illustrates a zipped-up state of the stem part. The waterproof cloth sheet is pushed into and housed in the canoe panel. FIG. 9 illustrates a process of inserting the bolt heads 21-3 into the third ribs 43 and rotating the third ribs 43 around the bolt heads 21-3 to make the third ribs 43 be oriented upright. FIG. 9 also illustrates a process of closely placing the two floor boards 46 between the third ribs 43. With regard to the structure of fastening the rib 43 to the bolt heads 21-3, for example, as shown in the enlarged view of FIG. 10, keyhole-shaped slots are formed in the rib 43, and each bolt head 21-3 is inserted into a large hole part of the corresponding slot and pushed along the slot such that the bolt head 21-3 is prevented from being removed from the slot. Subsequently, the rib is rotated around the bolt heads such that the rib is oriented to be perpendicular to the bottom of the canoe with the two floor boards placed between the two ribs. FIG. 11 illustrates a process of inserting the bolt heads 21-1 into the first rib 41 and rotating the first rib 41 around the bolt heads 21-1 to make the first rib 41 perpendicular to the bottom of the canoe, and then inserting the bolt heads 21-2 into the second ribs 42 and rotating the second ribs 42 around the bolt heads 21-2 such that the second ribs 42 are placed upright on the floor board 46 to push the floor boards 46 downward and thus reliably fix the floor boards 46 on the bottom of the canoe. FIG. 12 illustrates a process of successively pulling the eight buckles 27 provided on the side panels of the canoe boat such that the overall shape of the canoe becomes a smooth streamlined shape. FIG. 12 also illustrates processes of: fitting the gunwale caps over the gunwale to reinforce the gunwale and retain the smooth shape of the gunwale line; longitudinally fitting each H-cap 45 between a corresponding pair of deck parts, tightening the buckles 26, and then fitting the gunwale caps over the front edges of the deck parts so that the deck parts are fixed to be level with each other; placing each seat 47 on the corresponding second and third ribs and tightening a buckle (not shown) provided under the seat 47 to fix the seat 47 to the second and third ribs; and pulling the rubber cover 25 provided on the outer surface of the stem part and elastically covering the entirety of the stem part with the rubber cover 25. FIG. 13 shows enlarged views illustrating the gunwale cap fitted over the upper edge of the gunwale and the H-cap used to couple a pair of deck parts to each other. As illustrated in FIG. 12, the gunwale cap is also used for linearly connecting the edges of the deck parts to each other.

Next, a process of packing the foldable canoe according to the present invention to make it compact and facilitate transportation and storage of the canoe after used will be described with reference to FIGS. 14 through 25.

Figure 14:
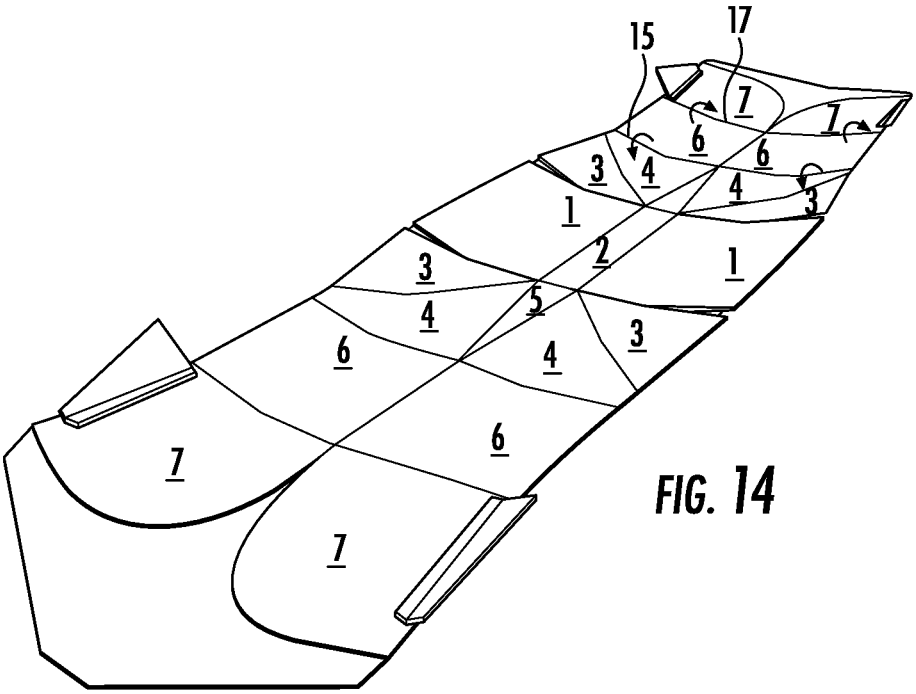
FIG. 14 is a development view showing the inner surface of a single panel used for forming the canoe to illustrate a process of packing the canoe.
Figure 15:
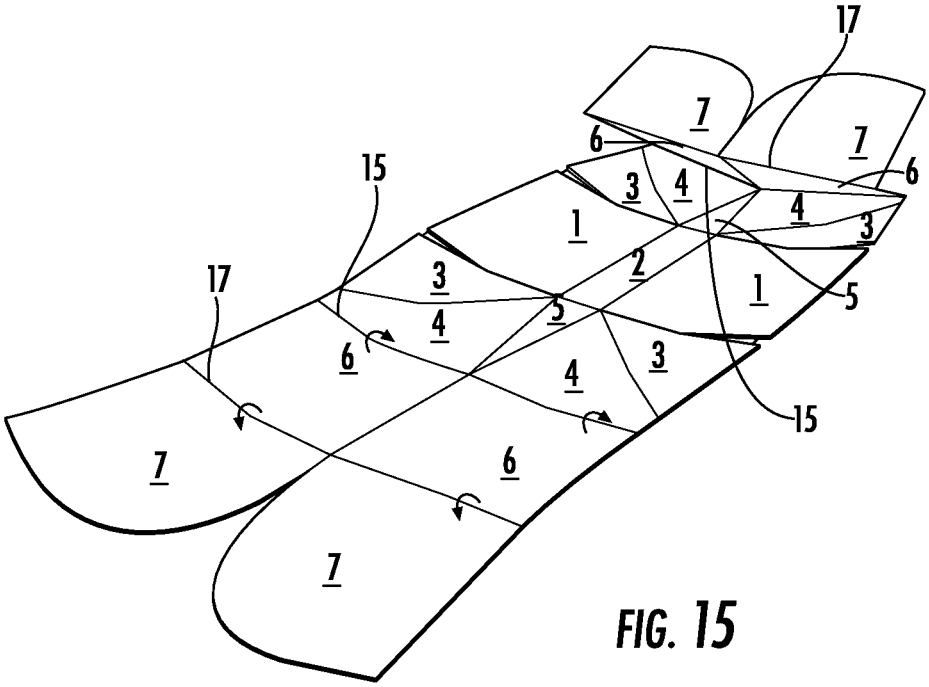
FIGS. 15 through 25 are perspective views showing a process of successively folding the single sheet to make the canoe be a package for storage.
Figure 16:
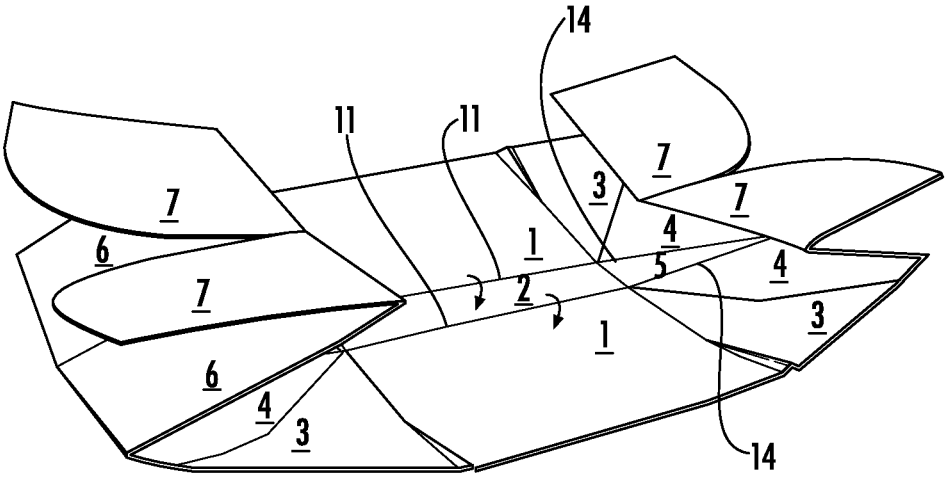
Figure 17:
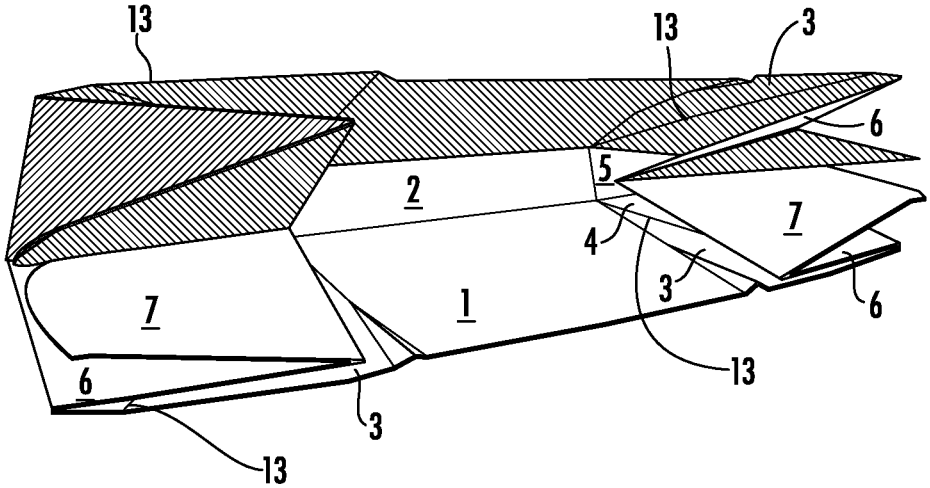
Figure 18:
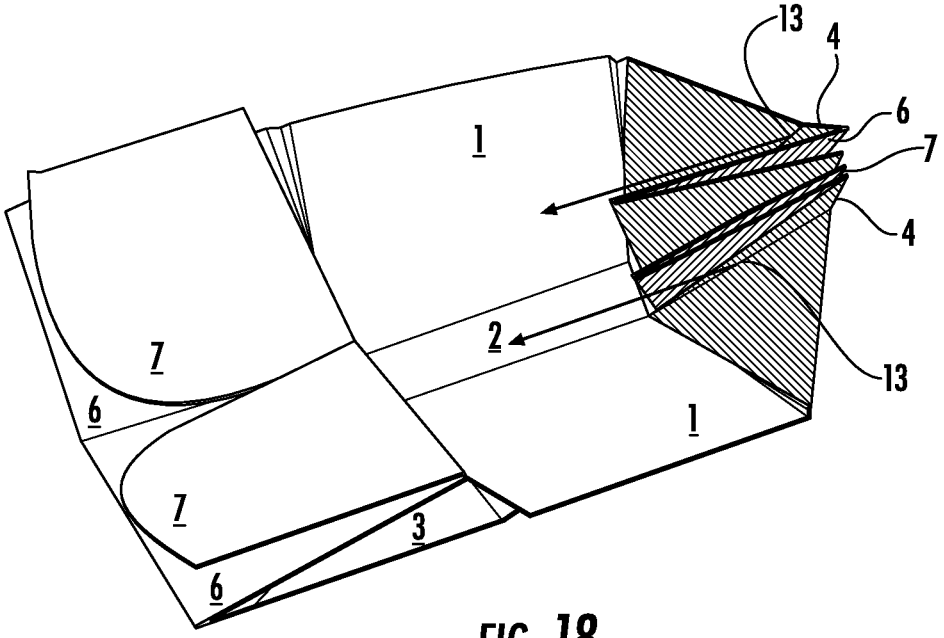
Figure 19:
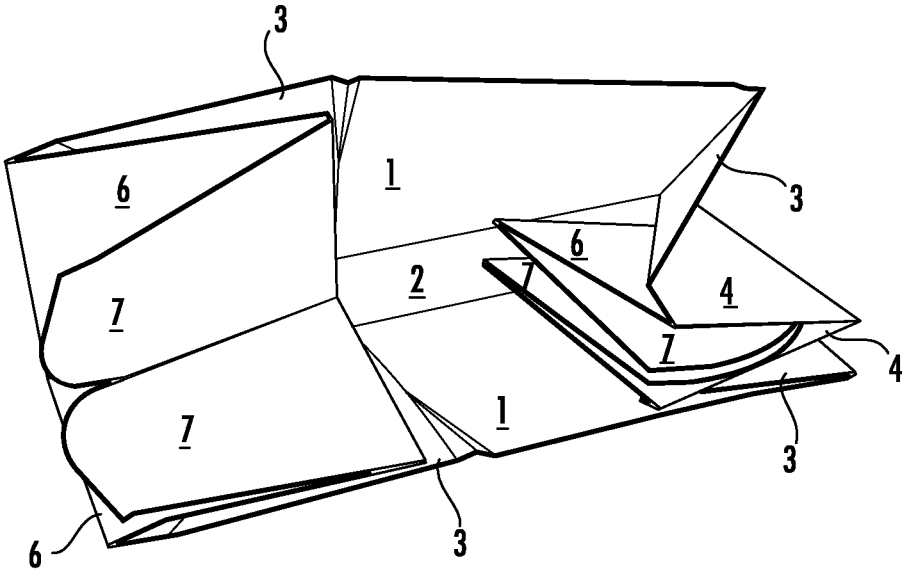
Figure 20:
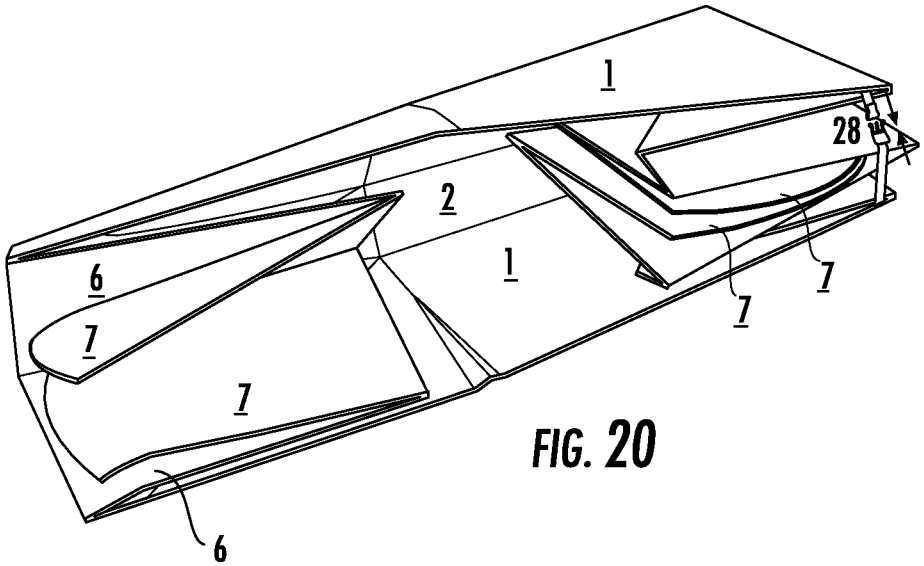
Figure 21:
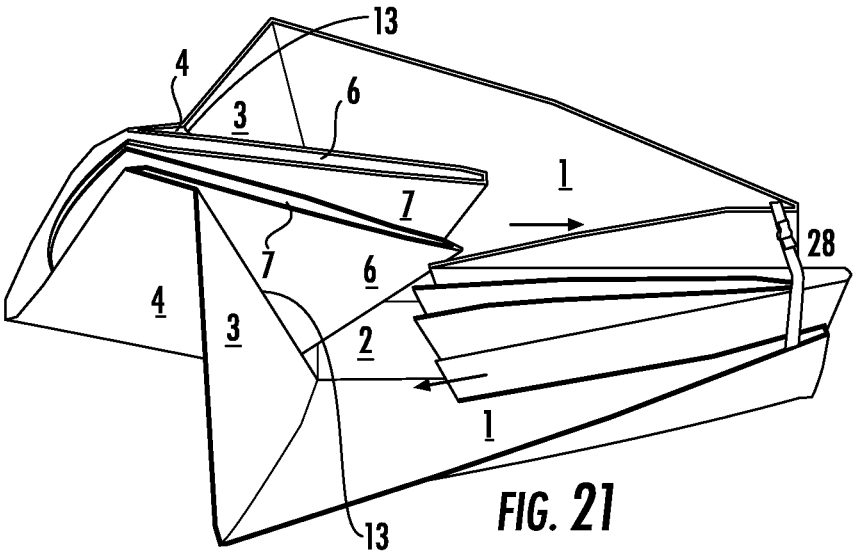
Figure 22:
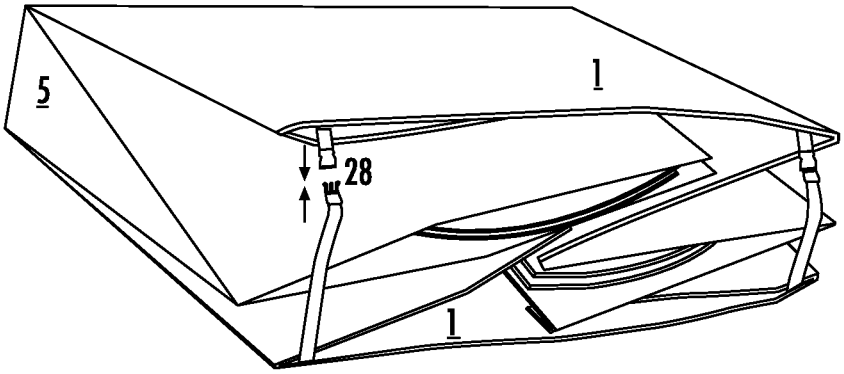

FIG. 14 is a development view showing the inner surface of a single panel used for forming the canoe to illustrate the packing process. As shown in FIGS. 14 and 15, the panel of the canoe is folded inward based on the folding lines 15 and then folded outward based on the folding lines 17. As shown in FIG. 16, the panel is folded inward based on the folding lines 11 and 14. Subsequently, as shown in FIG. 17, the panel is folded outward based on the folding lines 13 while the panel parts 6 and 7 are pulled inward such that the panel is folded as shown in FIG. 18. Thereafter, as shown in FIG. 19, the panel of the canoe is folded such that the panel parts 1 face and cover each other. As shown in FIG. 20, the buckle 28 provided on ends of the panel panels 1 is fastened such that first of all only a first end of the panel is temporarily closed. As shown in FIG. 21, the panel is folded along the folding lines 13 provided on a second end of the panel, and the panel parts 6 and 7 are pulled inward. Thereafter, as shown in FIG. 22, the buckle 28 provided on the panel parts 1 that is disposed on the second end of the panel is fastened. Both the buckles are tightened as needed so that the shape of the package becomes compact and neat. Subsequently, as shown in FIG. 23, one of the floor boards 46 that is provided without the rings covers a lower part of the folded canoe package, and the other floor board 46 with the rings covers an upper part of the canoe package. FIG. 24 illustrates process of finally packing the canoe panel using the buckles attached on the floor boards 46 and connecting the belt 48 to the rings to allow the user to easily carry the canoe package on his or her shoulder. FIG. 25 illustrates the completed canoe package. Meanwhile, the other elements 41 through 49 such as ribs are stored in the separate portable bag 49.

Figure 28:
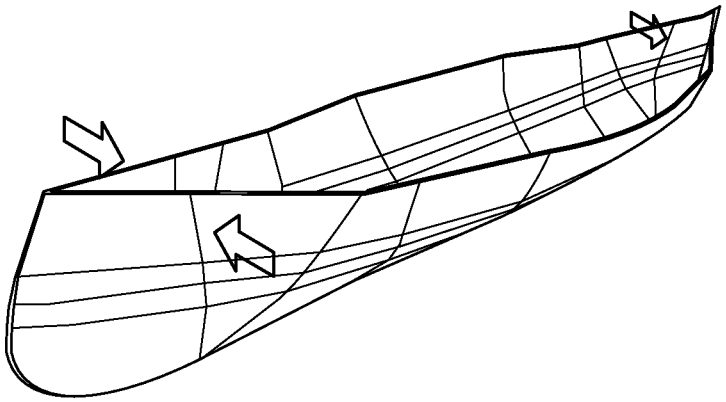
FIG. 28 illustrates another embodiment of the foldable canoe according to the present invention in which bow and stem parts of the canoe are previously integrally assembled.
Figure 29:
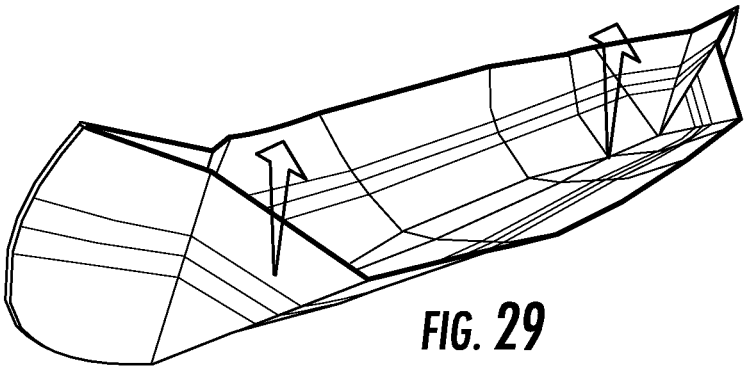
FIGS. 29 through 36 are views showing a process of folding the foldable canoe of FIG. 28 to make it be a package for storage.
Figure 30:
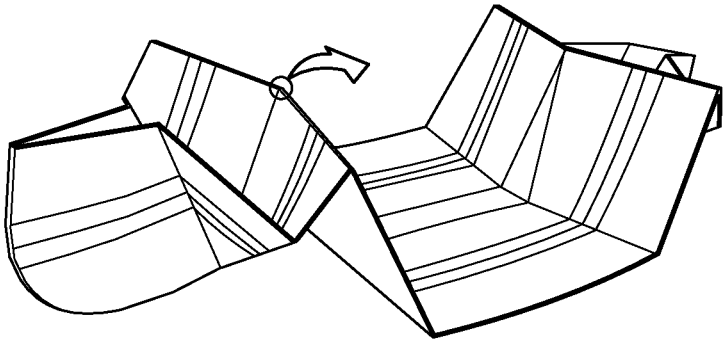
Figure 31:
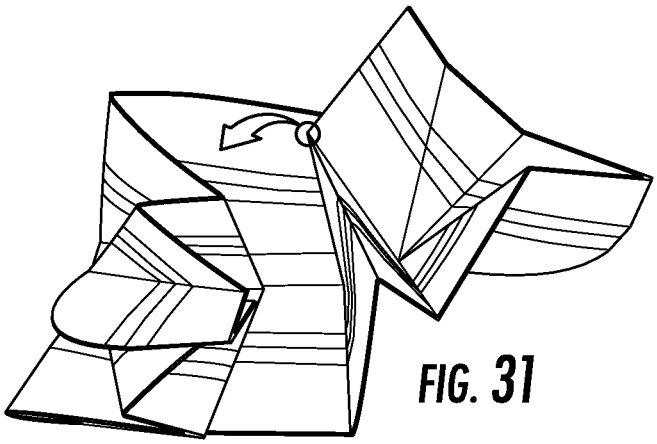
Figure 32:
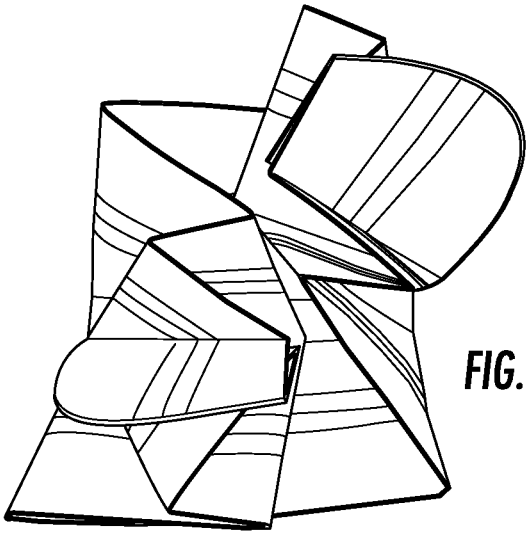
Figure 33:
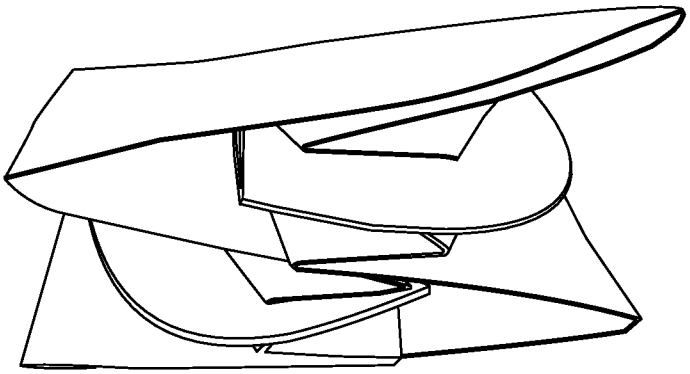
Figure 34:
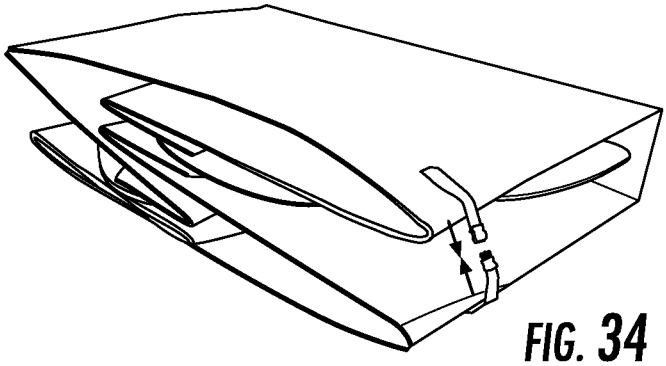
Figure 35:
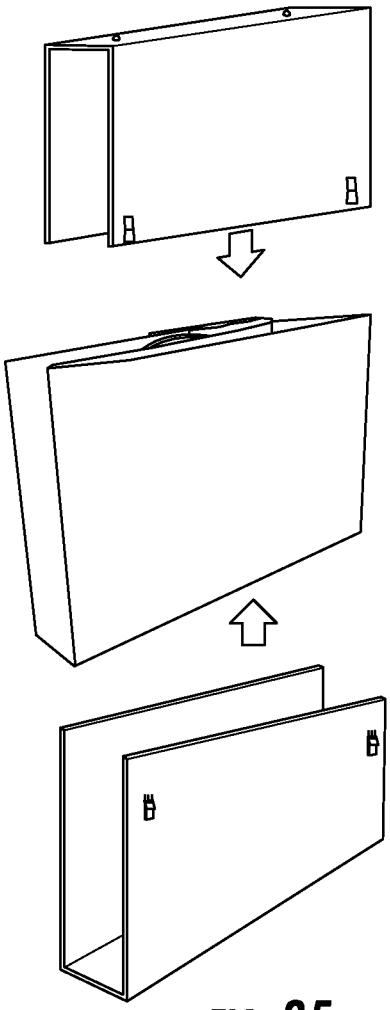
Figure 36:
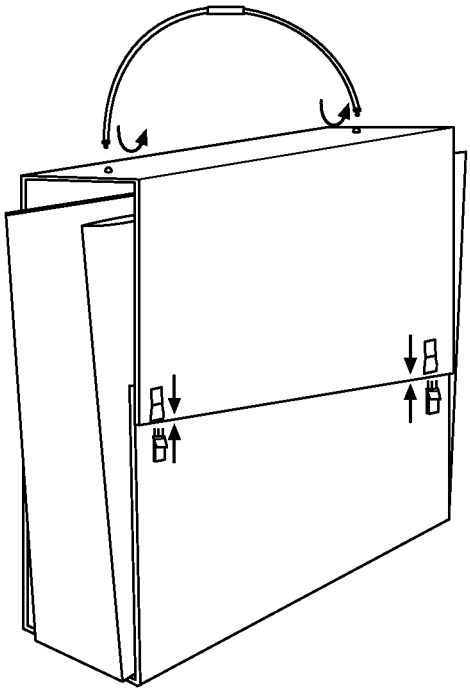

In the above-mentioned embodiment, each of the bow and stem parts has been illustrated as having the curved cut parts forming a bilateral symmetrical structure when the sheet is deployed and as being operatively contracted by the waterproof rubber band, the waterproof cloth sheet and the zipper to provide a boat shape, which is tapered in the bow and stem parts, when the sheet is assembled to construct the canoe. However, in another embodiment, as shown in FIG. 28, each of the bow and stem parts has a single part structure with a tapered shape and maintains the original shape even when the sheet is deployed and assembled to form a canoe or folded into a package shape for storage. FIGS. 29 through 36 are views showing a folding pattern in a process of successively folding the foldable canoe of FIG. 28 to form a canoe package.

The general configuration of the embodiment of FIGS. 28 through 36, other than the fact that each of the bow and stem parts is integrally watertightly formed, is the same as that of the earlier embodiment. This embodiment is advantageous in that because each of the bow and stem parts maintains the watertightly integrated structure regardless of the folded state of the sheet, water can be more reliably prevented from entering the canoe through the bow or stem part. Furthermore, in this embodiment, the process of folding the sheet into the package shape or unfolding the sheet that has been in the package shape and forming a canoe can be more easily conducted.

Figure 37:
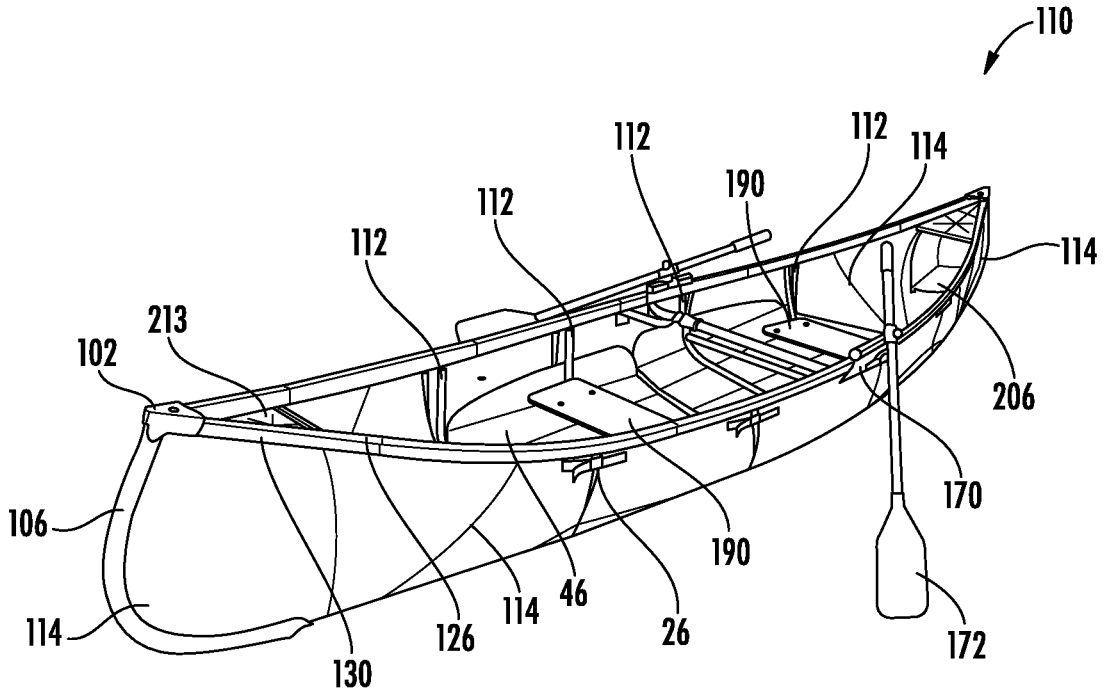
FIG. 37 illustrates a perspective view of a foldable canoe according to one embodiment of the present disclosure.
Figure 38A:
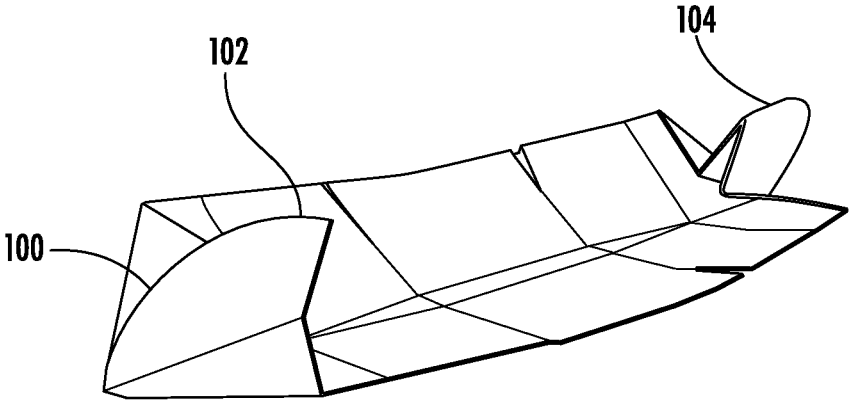
FIGS. 38A-38H illustrate folding of a hull formed of a sheet according to one embodiment of the present disclosure.
Figure 38B:
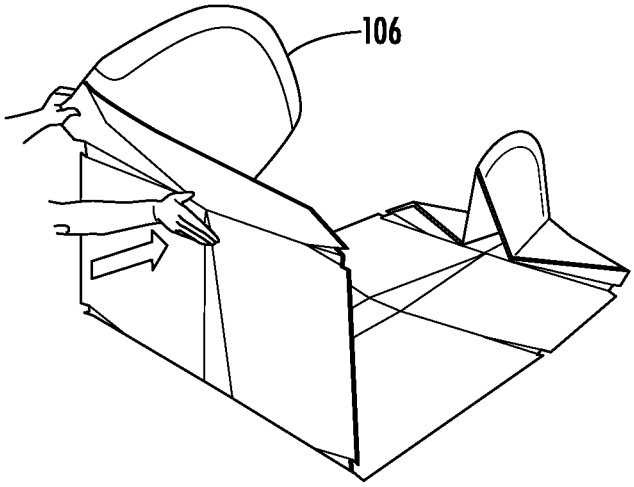
Figure 38C:
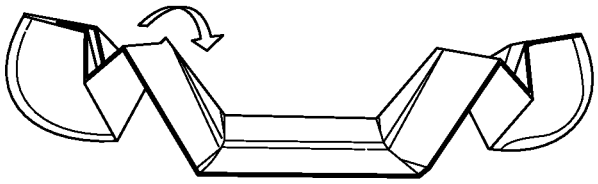
Figure 38D:
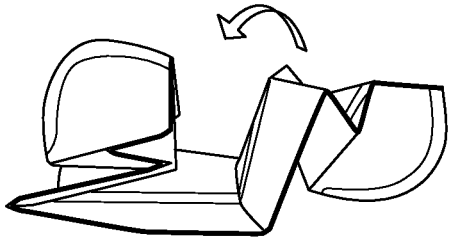
Figure 38E:
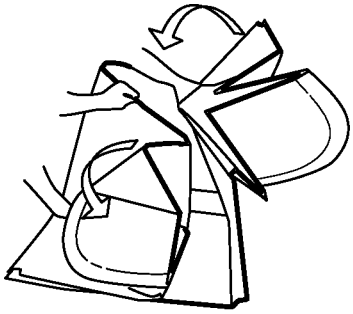
Figure 38F:
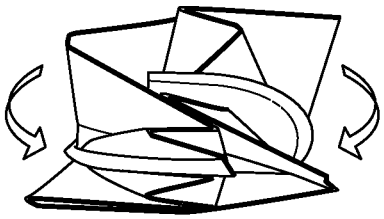
Figure 38G:
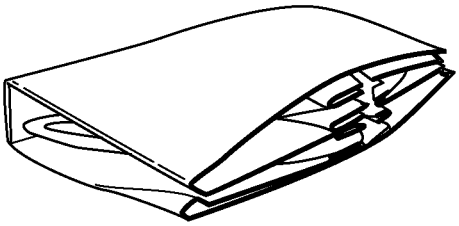
Figure 38H:
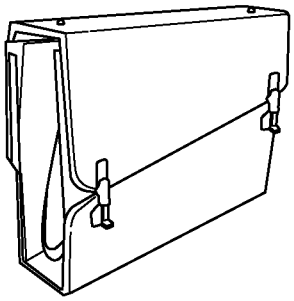

Additional features are of a foldable canoe 110 are shown in FIG. 37 and are discussed in greater detail below. Referring now to FIGS. 38A-38H, in one embodiment an edge 100 along a bow portion 102 and a stern portion 104 is sealed, such as by seam welding. For example, the edge 100 may be welded using a polypropylene welding rod or other material that is the same material as a material from which the canoe is constructed. In the embodiment of FIGS. 38A-38H, the canoe is foldable from an open configuration (FIG. 38A) to a folded configuration (FIG. 38H) with the bow portion 102 and stern portion 104 remaining sealed or welded along edge 100. In one embodiment, the bow portion 102 and stern portion 104 are welded along edge 100 and further concealed by a bow cap 106 that substantially protects the edge 100 along the bow portion 102 and stern portion 104.

Figure 39A:
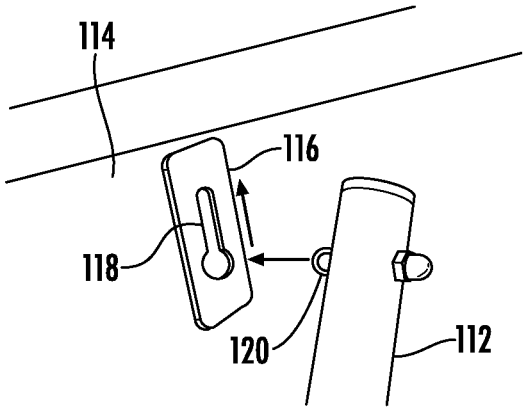
FIGS. 39A-39D illustrate installation of a rib in a foldable canoe according to one embodiment of the present disclosure.
Figure 39B:
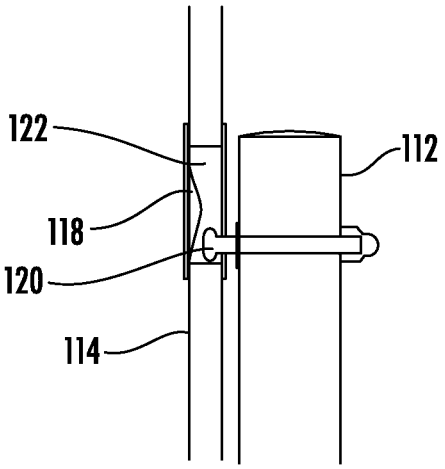
Figure 39C:
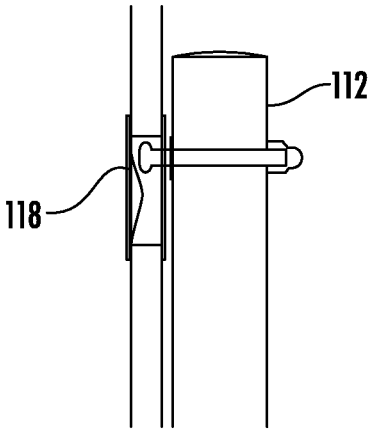
Figure 39D:
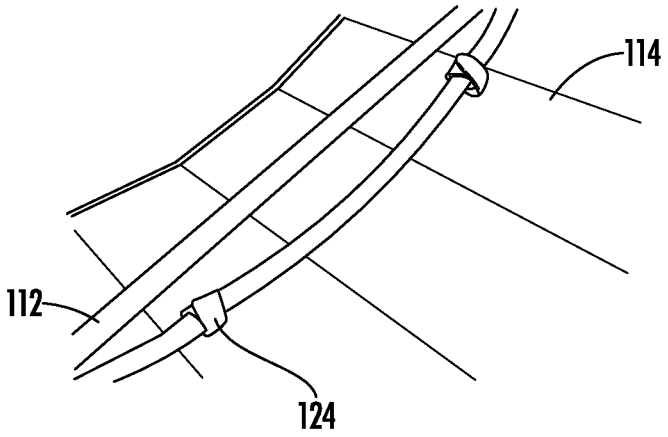

Referring now to FIG. 37, in one embodiment a foldable canoe 110 includes a plurality of U-shaped ribs 112 positioned along a length of the canoe 110 and spanning a width of the canoe 110. The plurality of ribs 112 are preferably releasably secured inside a hull 114 of the canoe 110 such that the ribs 110 reinforce a shape of the canoe 110 as described above. As shown in FIG. 39A, each of the ribs 110 is attached to the hull 114 at a plurality of keyholes 116 mounted on an inner portion of the hull 114. Each of the keyholes 116 preferably includes a spring 118, such as a leaf spring, to maintain a bolt head 120 located at an end of the ribs 110 within the keyholes 116. A recess 122 is preferably formed between a back side of the keyholes 116 and the spring 118 such that the bolt head 120 is capable of fitting within the recess 122 (FIGS. 39B and 39C). To engage the ribs 112 with the hull 114 of the canoe 110, the bolt head 120 is aligned with and inserted through a lower portion of the keyholes 116. After being inserted through the lower portion of the keyholes 116, the rib 112 is urged in an upward direction such that the bolt head 120 is moved towards an upper portion of the keyhole 116 and becomes substantially entrapped between the spring 118 and the keyhole 116. Referring to FIG. 39D, when the rib is fully engaged with the keyholes 116, the rib 112 is positioned substantially vertically relative to the hull 114 such that the rib 112 contacts a floor of the hull 114. The rib 112 may be maintained in a substantially vertical position by frictional contact of the rib 112 with the floor of the hull 114 or by the use of one or more securing mechanisms, such as Velcro straps 124.

Figure 40:
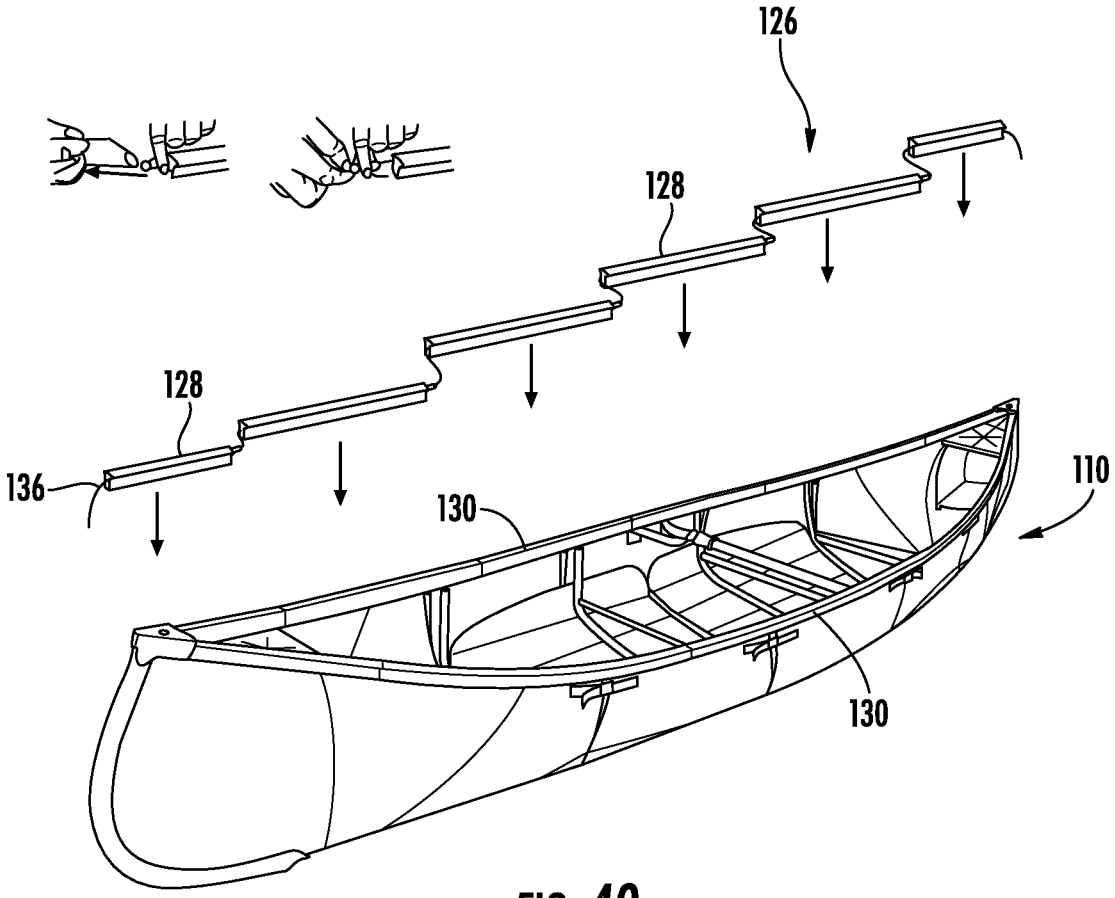
FIG. 40 illustrates installation of a gunwale cap according to one embodiment of the present disclosure.
Figure 41:
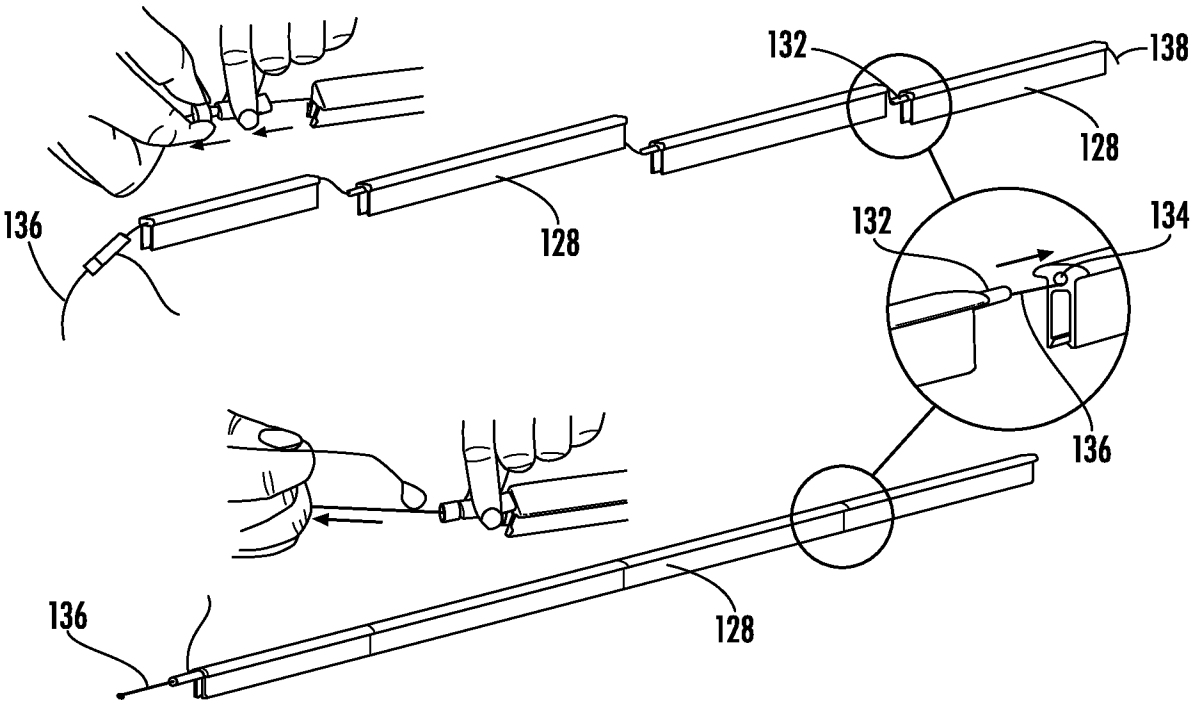
FIG. 41 illustrates a gunwale cap formed of a plurality of gunwale cap sections according to one embodiment of the present disclosure.

In one embodiment, as shown in FIG. 40, the foldable canoe 110 includes a gunwale cap 126 formed in a plurality of sections 128 that are joinable along a gunwale 130 of the foldable canoe 110. Referring to FIG. 41, each of the plurality of sections 128 are preferably elongate and include a pin 132, preferably being hollow, formed on a first end of the sections 128 and a bore 134 on a second end of the sections 128 shaped to receive the pin 132 of an adjacent section 128. The pin 132 and bore 134 are preferably sized and shaped such that the pin 132 and bore 134 may be secured to one another with a press fit or frictional engagement. A wire 136, such as a synthetic rope, steel wire, or cable, is inserted through each of the plurality of sections 128, such as through the bore 134 and pin 132 of each of the plurality of sections 128. The wire 136 includes stoppers 138 located at ends of the wire 136. A wire adjuster 140 is located towards an end of the wire and is securable along a length of the wire as described in greater detail below.

The plurality of sections 128 of the gunwale cap 126 are held together with the wire 136 inserted through each of the plurality of sections 128. When not installed on the canoe 110, the plurality of sections 128 are foldable relative to one another such that the gunwale cap 126 may be stored. The plurality of sections 128 of the gunwale cap 126 are preferably installed along a length of the gunwale 130 of the foldable canoe 110. Each of the plurality of sections 128 is joined with an adjoining section by inserting the pin 132 into the bore 134 of an adjoining section 128, as shown in FIG. 41. After joining adjacent sections 128, the plurality of sections 128 form the elongate linear gunwale cap 126.

Figure 42A:
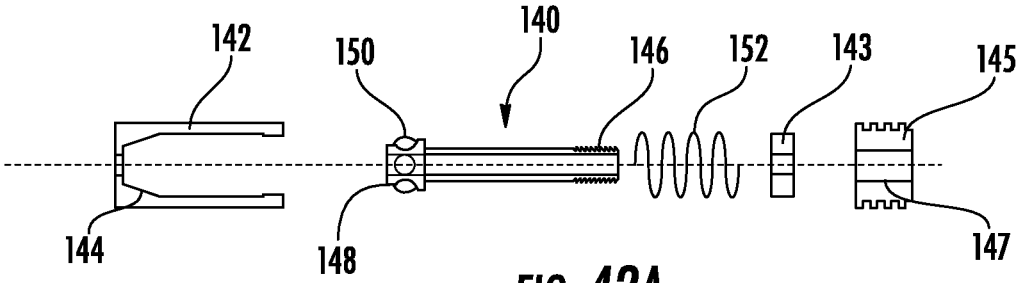
FIGS. 42A-42C illustrate a wire adjuster of a foldable canoe according to one embodiment of the present disclosure.
Figure 42B:
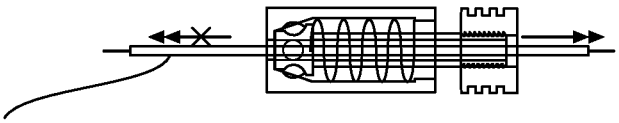
Figure 42C:
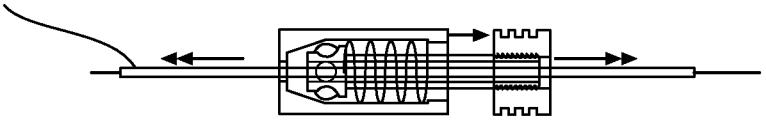
Figure 43:
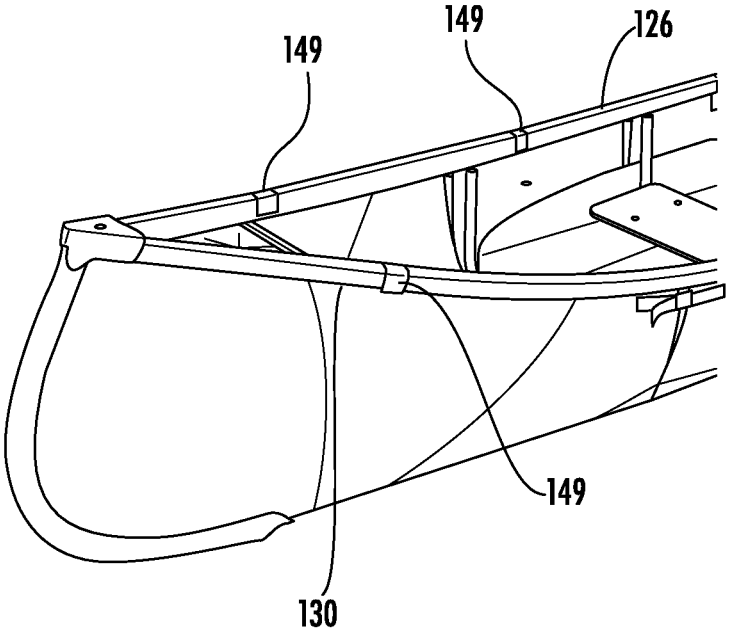
FIG. 43 illustrates a foldable canoe having a gunwale cap according to one embodiment of the present disclosure.

After connecting adjacent sections 128, the user may tighten the wire adjuster 140 to maintain the plurality of sections 128 in compression adjacent one another. Referring now to FIGS. 42A-42C, the wire adjuster 140 includes a hollow cylindrical cap 142 and a tapered inner portion 144 formed at an inside end of the cylindrical cap 142. A hollow rod 146 is threadably engaged with the hollow cylindrical cap 142 and includes a tapered head 148 formed on an end of the hollow rod 146. The tapered head 148 includes a plurality of balls 150 formed around the hollow rod 146 and extending at least partially into a hollow interior of the hollow rod 146 when the tapered head 148 is adjacent the tapered inner portion 144 of the wire adjuster 140. In one configuration, the hollow rod 146 and tapered head 148 are engaged with the hollow cylindrical cap 142 such that the plurality of balls 150 extend into the hollow interior of the hollow rod 146 to prevent the wire 136 from moving relative to the wire adjuster 140. In a disengaged configuration, the tapered head 148 is at least partially disengaged from the tapered inner portion 144 of the wire adjuster 140 such that the wire 136 is free to move relative to the wire adjuster 140. The wire adjuster 140 includes a spring 152 adjacent the tapered head 148 that biases the wire adjuster 140 towards the engaged position. The spring 152 is maintained within the hollow cylindrical cap 142 by an end cap 143 that may be threadably engaged with the hollow cylindrical cap 142. A handle 145 is threadably engaged with an end of the hollow rod 146 on a threaded interior 147 of the handle 145 to substantially secure the handle 145 to the hollow rod 146. Referring to FIG. 43, a plurality of straps 149, such as straps having hook and loop fasteners formed thereon, may be located along the gunwale 130 to secure the gunwale cap 126 to the gunwale 130.

Figure 44A:
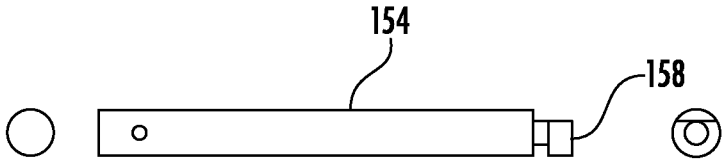
FIGS. 44A-44D illustrate a gunwale cap according to one embodiment of the present disclosure.
Figure 44B:
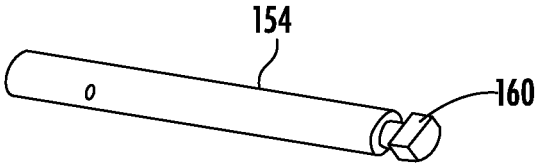
Figure 44C:
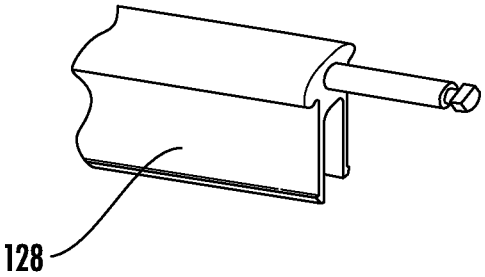
Figure 44D:
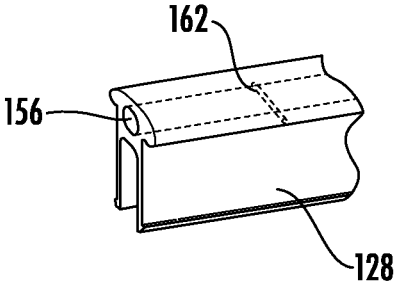

The plurality of sections 128 forming the gunwale cap 126 may be coupled by various other additional means. Referring now to FIGS. 44A-44D, in one embodiment the plurality of sections 128 forming the gunwale cap 126 are rotatively coupled to one another to maintain the plurality of sections 128 as in an elongate linear shape. Each of the plurality of sections 128 may include a connecting rod 154 shaped to fit within a connecting rod bore 156 formed in an end of an adjacent section 128. The connecting rod 154 preferably extends from ends of the plurality of sections and are aligned along a length of the gunwale cap 126. The connecting rod 154 includes a connecting rod head 158 having a flattened portion 160 located on an upper side of the connecting rod head 158. A connecting rod pin 162 is preferably located inside of the connecting rod bore 156, as shown in FIG. 44D. The connecting rod 154 is preferably maintained within the plurality of sections 128 with a rod pin 163.

Figure 45A:
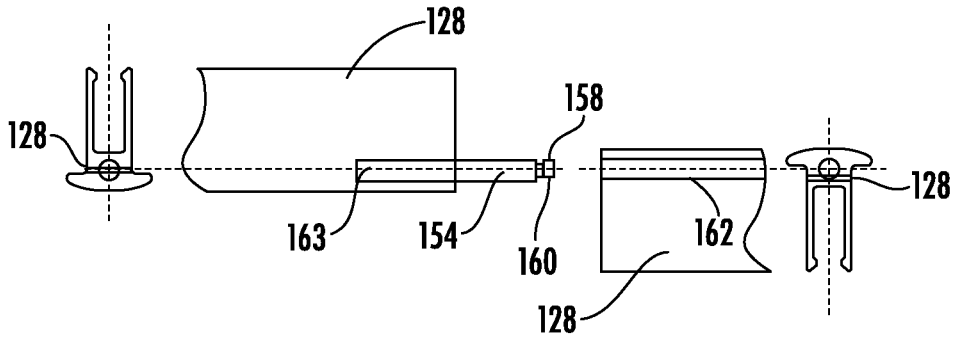
Figure 45B:
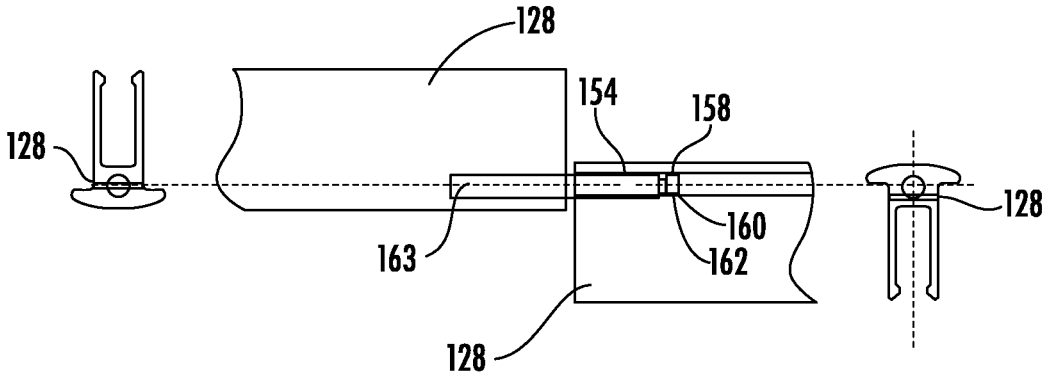
Figure 45C:
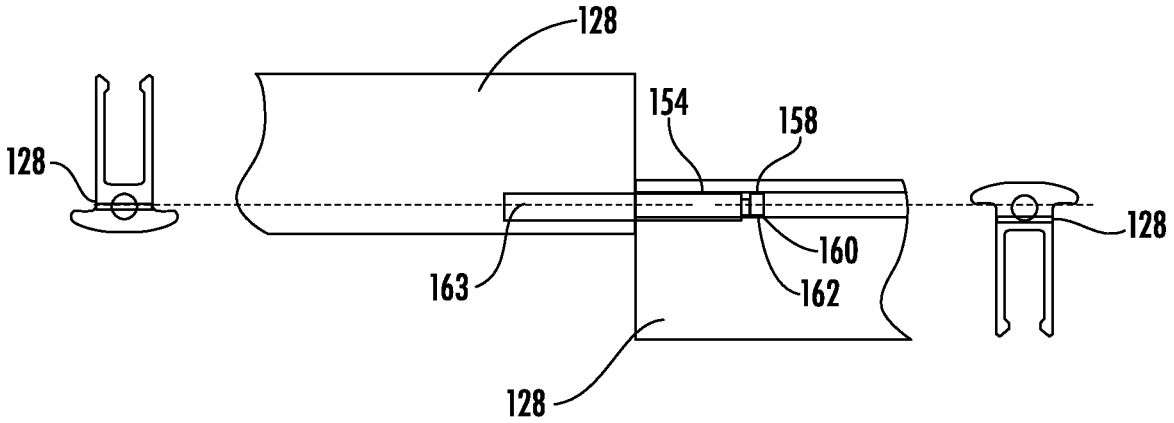
Figure 45D:
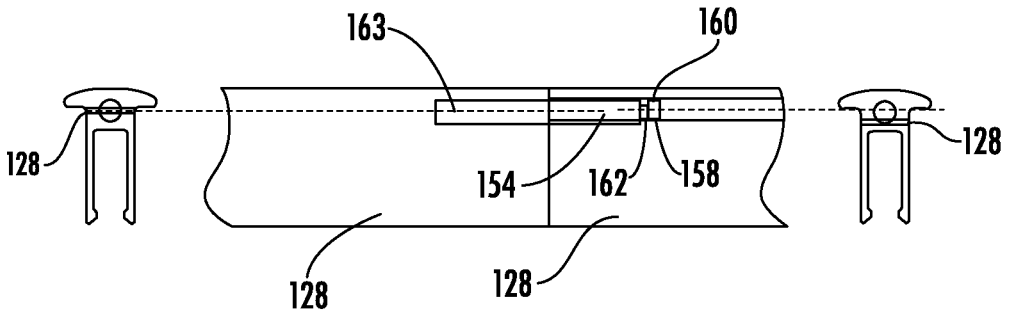
Figure 46A:
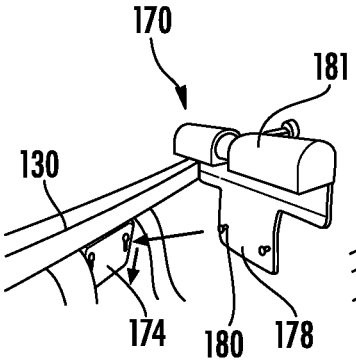
FIGS. 46A-46F illustrate an oar lock of a foldable canoe according to one embodiment of the present disclosure.
Figure 46B:
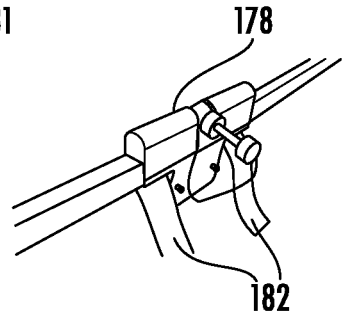
Figure 46C:
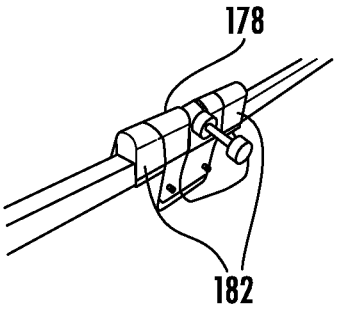
Figure 46D:
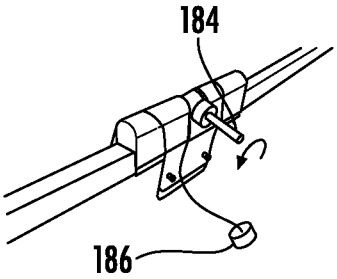
Figure 46E:
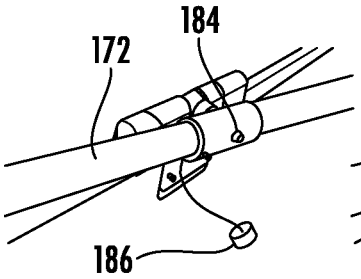
Figure 46F:
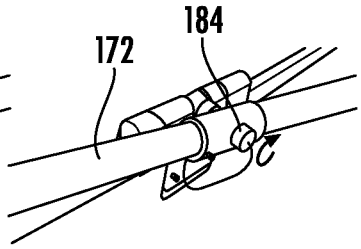

The connecting rod 154 and connecting rod bore 156 formed a keyed fit such that the connecting rod 154 couples one of the gunwale sections 128 to an adjacent gunwale section 128. To couple adjacent sections 128, adjoining sections are oriented substantially opposite or 180 degrees relative to one another. The connecting rod 154 is inserted into the connecting rod bore such that the connecting rod head 158 is inserted past the connecting rod pin 162. When the sections are oriented 180 degrees relative to one another, the flattened portion 160 is allowed to pass over the connecting rod pin 162, as shown in FIG. 45B. The connecting rod 154 is inserted into the connecting rod bore 156 until the adjacent sections 128 are abutting one another (FIG. 45C). The adjacent sections 128 are then rotated such that the adjacent sections are in alignment (FIG. 45D). When aligned, the connecting rod head 158 engages the connecting rod pin 162 such that the adjacent sections 128 may not be separated unless the adjacent sections 128 are rotated 180 degrees relative to one another.

Referring now to FIGS. 46A-46F, in one embodiment an oar lock 170 is provided for movably securing an oar 172 adjacent the gunwale 130 of the foldable canoe 110. An oar lock plate 174 is preferably mounted on an inner portion of the foldable canoe 110 adjacent the gunwale 130. The oar lock plate 174 includes a pair of oar lock keyholes 176 formed through the oar lock plate 174. An oar lock body 178 includes a pair of oar lock posts 180 aligned with the oar lock keyholes 176 of the oar lock plate 174 such that the oar lock body 178 is removably secured to the oar lock plate 174. When the oar lock body 178 is secured to the oar lock plate 174, an upper portion 181 of the oar lock body 178 is substantially aligned along a length of the gunwale 130. The oar lock body 178 may further be secured to the gunwale 130 with a band 182, such as a band having hook and loop fasteners formed on the band 182.

The oar lock 170 includes an oar pin 184 pivotally associated with the oar lock body 178. The oar pin 184 is shaped to fit through the oar 172 to pivotally retain the oar 172 on the oar lock body 178. An oar lock cap 186 is threadably engaged with an end of the oar pin 184 to substantially retain the oar 172 on the oar pin 184 and oar lock 170.

Figure 47A:
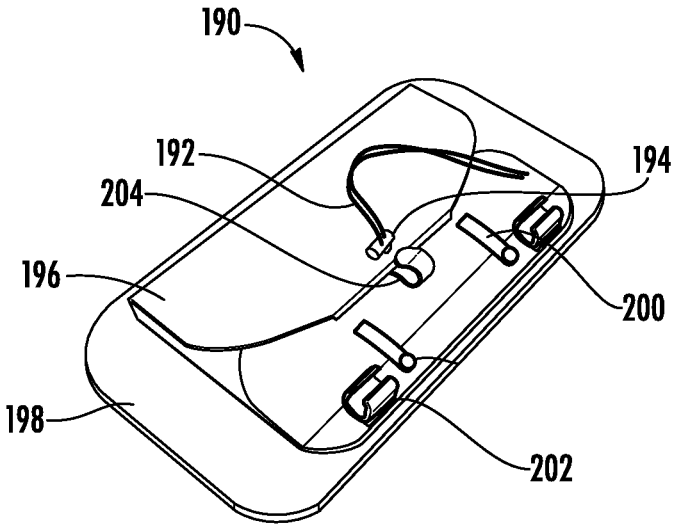
FIGS. 47A-47D illustrate a folding seat of a foldable canoe according to one embodiment of the present disclosure.
Figure 47B:
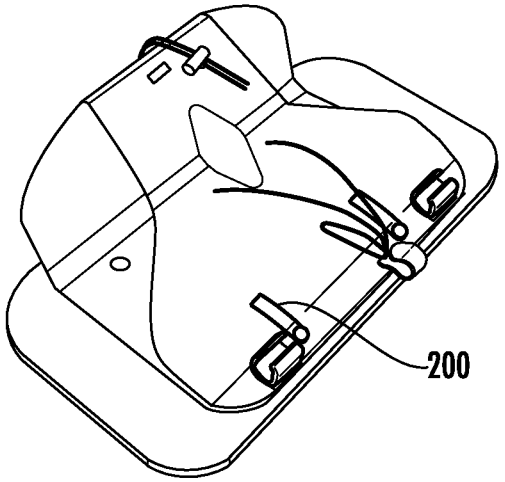
Figure 47C:
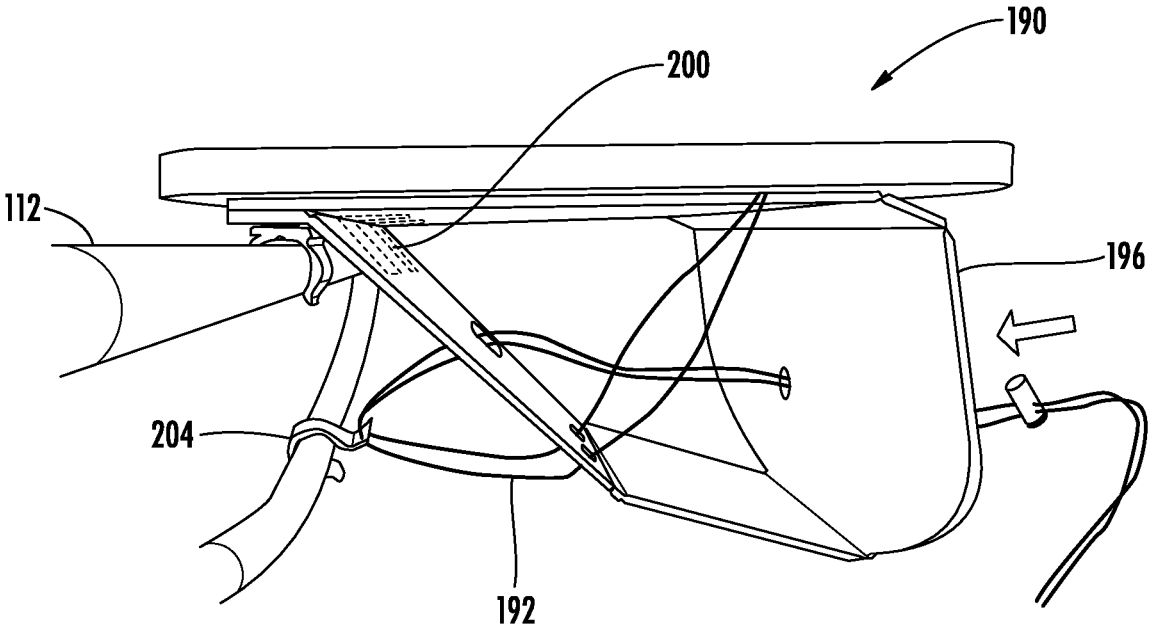
Figure 47D:
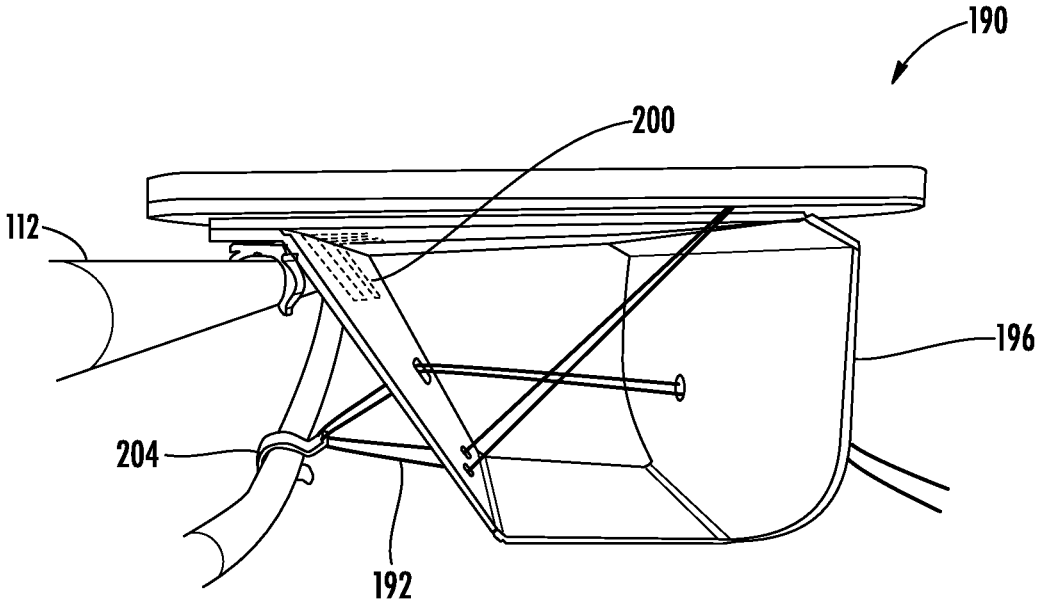
Figure 48:
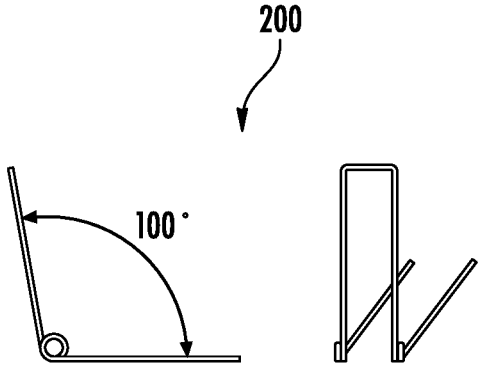
FIG. 48 illustrates a spring of a folding seat according to one embodiment of the present disclosure.

In one embodiment, the foldable canoe 110 includes a foldable seat 190. The foldable seat 190 is configured to be folded between a stowed position (FIG. 47A) and a deployed position (FIG. 47D) whereby the foldable seat 190 is installed in the foldable canoe 110 to support an occupant of the foldable canoe 110. The foldable seat 190 includes a seat wire 192 and a stopper 194 located on the seat wire 192. The foldable seat 190 includes a seat base 196 folded along a plurality of folds. The seat base 196 is secured to a bottom of a seat cushion 198 In the stowed position of FIG. 47A, the stopper 194 and seat wire 192 maintain the seat base 196 in a folded position such that the seat base 196 is folded adjacent to the seat cushion 198 such that the seat base 196 and seat cushion 198 are substantially parallel to one another and compact. When the stopper 194 is loosened and the wire 192 is allowed to pass through the stopper 194, the base portion is urged into an unfolded position by a pair of springs 200 (FIG. 48) attached between the seat base 196 and the seat cushion 198.

To attach the foldable seat 190 to the foldable canoe 110, a pair of seat clips 202 are attached a top portion of one of the plurality of ribs 112 installed in the foldable canoe 110. The seat wire 192 is inserted through a first side of the seat base 196 and through a second opposite side of the seat base 196. A seat hook 204 is slidably associated with the seat wire 192 and is preferably located opposite from the stopper 194. The seat hook 204 is shaped to engage a lower portion of the rib 112. After securing the seat hook 204 and pair of seat clips 202 to the rib 112, the seat wire 192 is pulled tight such that the seat base 196 is fully unfolded and a portion of the seat base 196 contacts a floor of the foldable canoe 110. The stopper 194 is then re-engaged with the seat wire 192 to maintain the foldable seat 190 in the deployed position.

Figure 49A:
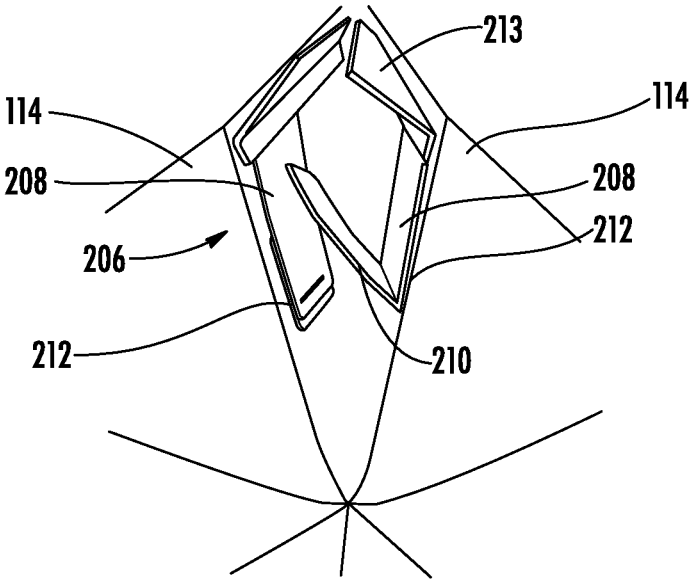
FIGS. 49A-49B illustrate an expander of a foldable canoe according to one embodiment of the present disclosure.
Figure 49B:
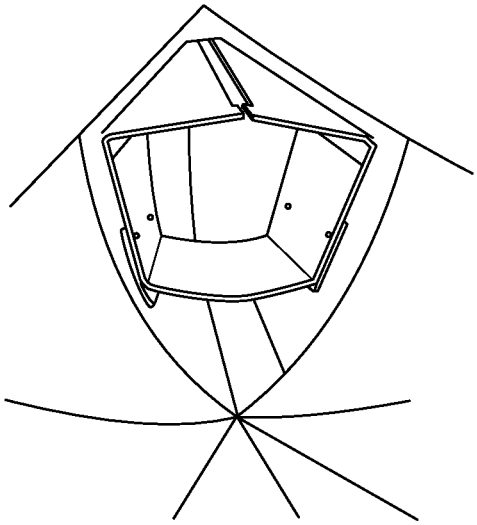

Referring to FIGS. 49A and 49B, in one embodiment the foldable canoe 110 may include an expander 206 located in a bow and stern of the foldable canoe 110. The expander 206 includes a pair of upright plates 208 formed on interior sides of the foldable canoe 110. A spreader plate 210 is pivotally attached to one of the upright plates 208 and is foldable between a stowed position wherein the spreader plate 210 is parallel to one of the upright plates 208 and a deployed position (FIG. 49B) wherein the spreader plate 210 extends across a width of an interior of the canoe 110 at the bow and stern. In one embodiment, one or more reinforcement plates 212 are located between the upright plates 208 and an inner surface of the foldable canoe 110. A deck portion 213 may be located above the expander 206 and becomes flattened when the expander 206 is deployed, as shown in FIG. 49B.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A foldable canoe comprising a hull having a bow portion, a stern portion, a port side, a starboard side, and a gunwale formed around the hull, the hull formed of an elongate sheet of synthetic material having a plurality of folds including at least one longitudinal fold along a length of the sheet and one or more horizontal folds formed across a width of the sheet, wherein the hull is configured to be folded into a stored configuration along the at least one longitudinal fold and one or more horizontal folds of the elongate sheet;

one or more ribs installed across a width of the hull, the one or more ribs removably installed inside the hull for maintaining the elongate sheet in a shape of the hull;

a gunwale cap including a channel shaped to removably fit over the gunwale of the hull, the gunwale cap formed of a plurality of adjoining gunwale sections, wherein each of the plurality of adjoining gunwale sections is removably secured to adjacent gunwale sections, the plurality of gunwale sections further comprising a hollow pin extending from a first end of the gunwale section toward an adjacent gunwale section, a bore formed in a second end of the gunwale section shaped to receive the hollow pin extending from an adjacent gunwale section, and a wire extending through the hollow pin and the bore of the plurality of gunwale sections for connecting the plurality of gunwale sections when the plurality of gunwale sections are separated;

wherein in a deployed configuration the plurality of adjoining gunwale sections are joined such that the gunwale cap maintains a shape of the gunwale of the hull, and wherein in a stored configuration the plurality of adjoining gunwale sections are separated such that the gunwale cap is folded into a stowed configuration.

2. The foldable canoe of claim 1, further comprising stoppers located at opposing ends of the wire and a wire adjuster adjustably located on the wire between one of the stoppers and one of the gunwale sections, wherein the wire adjuster is adjustable along a length of the wire for tightening the wire to maintain the plurality of gunwale sections in a joined configuration.

3. The foldable canoe of claim 1, wherein one or more of the plurality of gunwale sections of the gunwale cap further comprise:

a connecting rod extending from a first end of the gunwale section toward an adjacent gunwale section and a connecting rod bore formed in a second end of the gunwale section and shaped to receive the connecting rod of an adjacent gunwale section;

wherein the connecting rod and connecting rod bore form a keyed connection such that adjoining gunwale sections may be rotatively secured to one another.

4. The foldable canoe of claim 3, wherein the connecting rod further comprises a connecting rod head having a flattened portion formed thereon, the connecting rod bore further comprising a pin extending across a width of the connecting rod bore, wherein the connecting rod head and pin formed a keyed connection between adjacent gunwale sections.

5. The foldable canoe of claim 1, further comprising:

a pair of opposing keyholes mounted on an inner surface of the hull, each of the keyholes comprising a spring formed adjacent the keyholes;

a pair of bolt heads extending from ends of the one or more ribs, the bolt heads shaped to be inserted through at least a portion of the keyhole such that the spring contacts the bolt head to resist releasing the bolt head from the keyhole.

6. The foldable canoe of claim 1, further comprising an expander located within the hull at one of the bow portion and stern portion of the hull for maintaining a shape of the hull, the expander including a pair of opposing upright plates mounted on an interior of the hull and a spreader plate extending between the pair of opposing upright plates.

7. The foldable canoe of claim 1, wherein a spreader plate is hingedly attached to one of the pair of opposing upright plates.

8. The foldable canoe of claim 6, further comprising a pair of reinforcement plates located between each of the pair of opposing upright plates and the hull.

9. The foldable canoe of claim 1, further comprising a pair of oar locks, each of the oar locks including:

an oar lock plate mounted to the hull adjacent the gunwale, the oar lock plate each at least one keyhole formed through oar lock plate;

an oar lock body including at least one oar lock post extending from the oar lock body and shaped to engage the at least one key hole formed through the oar lock plate;

an oar pin pivotally associated with the oar lock body for receiving an oar;

an oar pin cap removably associated with the oar pin for securing an oar on the oar pin.

10. The foldable canoe of claim 1, further comprising one or more straps attached along the gunwale for securing the gunwale cap to the gunwale.

11. The foldable canoe of claim 1, further comprising a foldable seat removably installed on the hull, the foldable seat including:

a seat cushion;

a foldable seat base attached to a bottom of the seat cushion, the foldable seat base configurable in an open position wherein the seat base supports the seat cushion on a floor of the canoe and a stowed position wherein the seat base is folded against the seat cushion;

at least one clip located adjacent the bottom of the seat cushion for engaging an upper portion of the rib; and a seat hook located on the seat base for engaging a lower portion of the rib.

12. The foldable canoe of claim 11, the foldable seat further comprising a seat wire extending through the seat base for pulling the seat base into the open position, wherein the seat hook is slidably attached to the seat wire.

13. The foldable canoe of claim 11, the foldable seat further comprising at least one spring positioned between the seat cushion and the foldable seat base such that the foldable seat base is biased towards the open position.

14. A foldable canoe comprising a hull having a bow portion, a stern portion, a port side, a starboard side, and a gunwale formed around the hull, the hull formed of an elongate sheet of synthetic material having a plurality of folds including at least one longitudinal fold along a length of the sheet and one or more horizontal folds formed across a width of the sheet, wherein the hull is configured to be folded into a stored configuration along the at least one longitudinal fold and one or more horizontal folds of the elongate sheet;

one or more ribs installed across a width of the hull, the one or more ribs removably installed inside the hull for maintaining the elongate sheet in a shape of the hull;

a pair of opposing keyholes mounted on an inner surface of the hull, each of the keyholes comprising a spring formed adjacent the keyholes;

a pair of bolt heads extending from ends of the one or more ribs, the bolt heads shaped to be inserted through at least a portion of the keyhole such that the spring contacts the bolt head to resist releasing the bolt head from the keyhole;

a gunwale cap including a channel shaped to removably fit over the gunwale of the hull, the gunwale cap formed of a plurality of adjoining gunwale sections, wherein each of the plurality of adjoining gunwale sections is removably secured to adjacent gunwale sections;

wherein in a deployed configuration the plurality of adjoining gunwale sections are joined such that the gunwale cap maintains a shape of the gunwale of the hull, and wherein in a stored configuration the plurality of adjoining gunwale sections are separated such that the gunwale cap is folded into a stowed configuration.

15. The foldable canoe of claim 14, further comprising a wire extending through hollow pin and the bore of the plurality of gunwale sections for connecting the plurality of gunwale sections when the plurality of gunwale sections are separated.

16. The foldable canoe of claim 14, further comprising one or more straps attached along the gunwale for securing the gunwale cap to the gunwale.

17. The foldable canoe of claim 15, further comprising stoppers located at opposing ends of the wire and a wire adjuster adjustably located on the wire between one of the stoppers and one of the gunwale sections, wherein the wire adjuster is adjustable along a length of the wire for tightening the wire to maintain the plurality of gunwale sections in a joined configuration.

18. A foldable canoe comprising a hull having a bow portion, a stern portion, a port side, a starboard side, and a gunwale formed around the hull, the hull formed of an elongate sheet of synthetic material having a plurality of folds including at least one longitudinal fold along a length of the sheet and one or more horizontal folds formed across a width of the sheet, wherein the hull is configured to be folded into a stored configuration along the at least one longitudinal fold and one or more horizontal folds of the elongate sheet;

one or more ribs installed across a width of the hull, the one or more ribs removably installed inside the hull for maintaining the elongate sheet in a shape of the hull;

a gunwale cap including a channel shaped to removably fit over the gunwale of the hull, the gunwale cap formed of a plurality of adjoining gunwale sections;

a pair of oar locks, each of the oar locks including:

an oar lock plate mounted to the hull adjacent the gunwale, the oar lock plate each at least one keyhole formed through oar lock plate;

an oar lock body including at least one oar lock post extending from the oar lock body and shaped to engage the at least one key hole formed through the oar lock plate;

an oar pin pivotally associated with the oar lock body for receiving an oar;

an oar pin cap removably associated with the oar pin for securing an oar on the oar pin;

wherein in a deployed configuration the plurality of adjoining gunwale sections are joined such that the gunwale cap maintains a shape of the gunwale of the hull, and wherein in a stored configuration the plurality of adjoining gunwale sections are separated such that the gunwale cap is folded into a stowed configuration.

* * * * *